US010219958B2

(12) United States Patent
Johnson et al.

(10) Patent No.: US 10,219,958 B2
(45) Date of Patent: Mar. 5, 2019

(54) BED SYSTEMS AND METHODS

(71) Applicant: KAP Medical, Inc., Corona, CA (US)

(72) Inventors: Michael Karl Johnson, Norco, CA (US); Taylor Allen Ressel, Corona, CA (US)

(73) Assignee: KAP Medical, Inc., Corona, CA (US)

( * ) Notice: Subject to any disclaimer, the term of this patent is extended or adjusted under 35 U.S.C. 154(b) by 537 days.

(21) Appl. No.: 14/940,956

(22) Filed: Nov. 13, 2015

(65) Prior Publication Data

US 2016/0136022 A1 May 19, 2016

Related U.S. Application Data

(60) Provisional application No. 62/078,991, filed on Nov. 13, 2014.

(51) Int. Cl.

| | |
|---|---|
| ***A61G 7/012*** | (2006.01) |
| ***A61G 7/018*** | (2006.01) |
| ***A61G 7/08*** | (2006.01) |
| *A61G 7/015* | (2006.01) |

(52) U.S. Cl.

CPC ..... *A61G 7/012* (2013.01); *A61G 7/018* (2013.01); *A61G 7/08* (2013.01); *A61G 7/015* (2013.01)

(58) Field of Classification Search

CPC ..... A61G 7/00; A61G 7/002; A61G 7/005; A61G 7/012; A61G 7/015; A61G 7/018; A61G 7/08

See application file for complete search history.

(56) References Cited

U.S. PATENT DOCUMENTS

| | | | |
|---|---|---|---|
| 3,436,769 | A | 4/1969 | Burst |
| 3,958,283 | A | 5/1976 | Adams et al. |
| 5,636,394 | A | 6/1997 | Bartley |
| 5,692,254 | A | 12/1997 | Boettcher |
| 6,212,714 | B1 | 4/2001 | Allen et al. |
| 6,321,878 | B1 | 11/2001 | Mobley et al. |
| 6,357,065 | B1 | 3/2002 | Adams |
| 6,390,213 | B1 | 5/2002 | Bleicher |
| 6,658,680 | B2 | 12/2003 | Osborne et al. |
| 6,834,402 | B2 | 12/2004 | Hanson et al. |
| 7,311,161 | B2 | 12/2007 | Lee |
| 7,334,277 | B2 | 2/2008 | Johnson |
| 7,428,760 | B2 | 9/2008 | McCimmon |

(Continued)

FOREIGN PATENT DOCUMENTS

| | | |
|---|---|---|
| CA | 2718539 | 10/2009 |
| CN | 101999967 | 6/2011 |

(Continued)

OTHER PUBLICATIONS

Lockelec Innovation, Hospital Bed Mover—Lockwood Electric—Innovation, http://lockelec.com.au/health-care/hospital-bed-mover/, 4 pages, available at least as early as Oct. 7, 2014.

(Continued)

*Primary Examiner* — Eric J Kurilla
(74) *Attorney, Agent, or Firm* — Faegre Baker Daniels LLP

(57) ABSTRACT

A bed is provided. The bed may include a lift system which raises and lowers a support deck of the bed. The lift system may include multiple individually actuatable lift systems. The bed may include a powered bed mover system.

9 Claims, 40 Drawing Sheets

(56) References Cited

U.S. PATENT DOCUMENTS

| | | | | |
|---|---|---|---|---|
| 7,454,809 | B2 | 11/2008 | Gowda | |
| 7,533,742 | B2 | 5/2009 | Johnson et al. | |
| 7,676,866 | B2 | 3/2010 | Toms et al. | |
| 7,690,059 | B2 | 4/2010 | Lemire et al. | |
| 7,805,784 | B2 | 10/2010 | Lemire et al. | |
| 7,845,032 | B2 | 12/2010 | Chambers et al. | |
| 7,861,334 | B2 | 1/2011 | Lemire et al. | |
| 7,913,335 | B2 | 3/2011 | Carr | |
| RE43,193 | E * | 2/2012 | Osborne | A47C 19/045 5/600 |
| 8,151,387 | B2 | 4/2012 | Osborne et al. | |
| 8,746,710 | B2 | 6/2014 | Schejbal | |
| 8,997,282 | B2 | 4/2015 | Bossingham et al. | |
| 2008/0010748 | A1 | 1/2008 | Menkedick et al. | |
| 2008/0098532 | A1 | 5/2008 | Gowda | |
| 2008/0189856 | A1* | 8/2008 | Toms | A47C 19/045 5/424 |
| 2009/0077748 | A1 | 6/2009 | Kim | |
| 2009/0282616 | A1* | 11/2009 | Carr | A61G 7/012 5/611 |
| 2010/0223728 | A1 | 9/2010 | Hutchison | |
| 2011/0113561 | A1 | 5/2011 | Douglas | |
| 2011/0162141 | A1 | 7/2011 | Lemire et al. | |
| 2014/0259413 | A1 | 8/2014 | Johnson et al. | |

FOREIGN PATENT DOCUMENTS

| | | |
|---|---|---|
| CN | 102247252 | 11/2011 |
| EP | 0074660 | 3/1983 |
| EP | 2353964 A2 | 8/2011 |
| FR | 2726982 | 5/1996 |

OTHER PUBLICATIONS

DJ Products, Inc., Cart Pullers, Cart Pushers, Motorized Carts, Powered Carts, Cart Movers, http://www.lindbeigh.com/products/index.html, 3 pages, available at least as early as Oct. 7, 2014.

Humphries Casters and Supplies, Gzunda Hospital Bed Mover, http://www.electrictuggers.com/more-details.html, 4 pages, available at least as early as Oct. 7, 2014.

International Search Report of the International Searching Authority, PCT/US2015/060634, dated Feb. 26, 2016, 5 pgs.

Written Opinion of the International Searching Authority, PCT/US2015/060634, dated Feb. 26, 2016, 7 pgs.

* cited by examiner

BED SYSTEMS AND METHODS

RELATED APPLICATION

The present application claims priority to U.S. Provisional Patent Application No. 62/078,991, entitled BED SYSTEMS AND METHODS, filed Nov. 13, 2014, the entire disclosure of which is expressly incorporated by reference herein.

The present application is related to U.S. patent application Ser. No. 14/208,987, titled BED SYSTEMS AND METHOD, filed Mar. 13, 2014; which claims the benefit U.S. Provisional Application Ser. No. 61/791,496, filed Mar. 15, 2013, titled BED SYSTEMS AND METHOD, the entire disclosures of which are expressly incorporated by reference herein

FIELD

The disclosure relates in general to beds and, more particularly, to beds having moveable frame components.

BACKGROUND

Some hospital patients have a tendency to roll out of a hospital bed. Falling from a surface of a normal height bed presents a significant risk of injury. To prevent a patient from falling off the surface of a bed, hospitals and care facilities have used various types of restraints to secure patients. However, patient restraints are no longer a viable option in many hospitals. One widely accepted solution to this problem has been to bring or locate the mattress platform of the bed as close to the surface floor as possible, yet still have the bed be able to raise the mattress platform back to normal bed height if not higher. The construction of an extremely low profile bed is limited by design due to the arrangement of the actuators to achieve angles of lift. When the frame of the bed folds up into itself to minimize the bed frame height in order to bring the patient support platform as close as possible to the floor, the actuators lose most of their vertical force component due to a shallow angle created by the actuators positioning themselves almost horizontally relative to the floor. In addition, often the caster wheels which are needed to move the bed with or without a patient in the bed are placed under the bed deck as well thus limiting the bed's ability to go as low as possible.

Accordingly, it is desirable to provide an improved bed system that overcomes one or more of the aforementioned drawbacks or other limitations of the prior art.

BRIEF DESCRIPTION OF THE DRAWINGS

The mentioned features and advantages and other features and advantages of this disclosure, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION OF THE DRAWINGS

Figure 1:
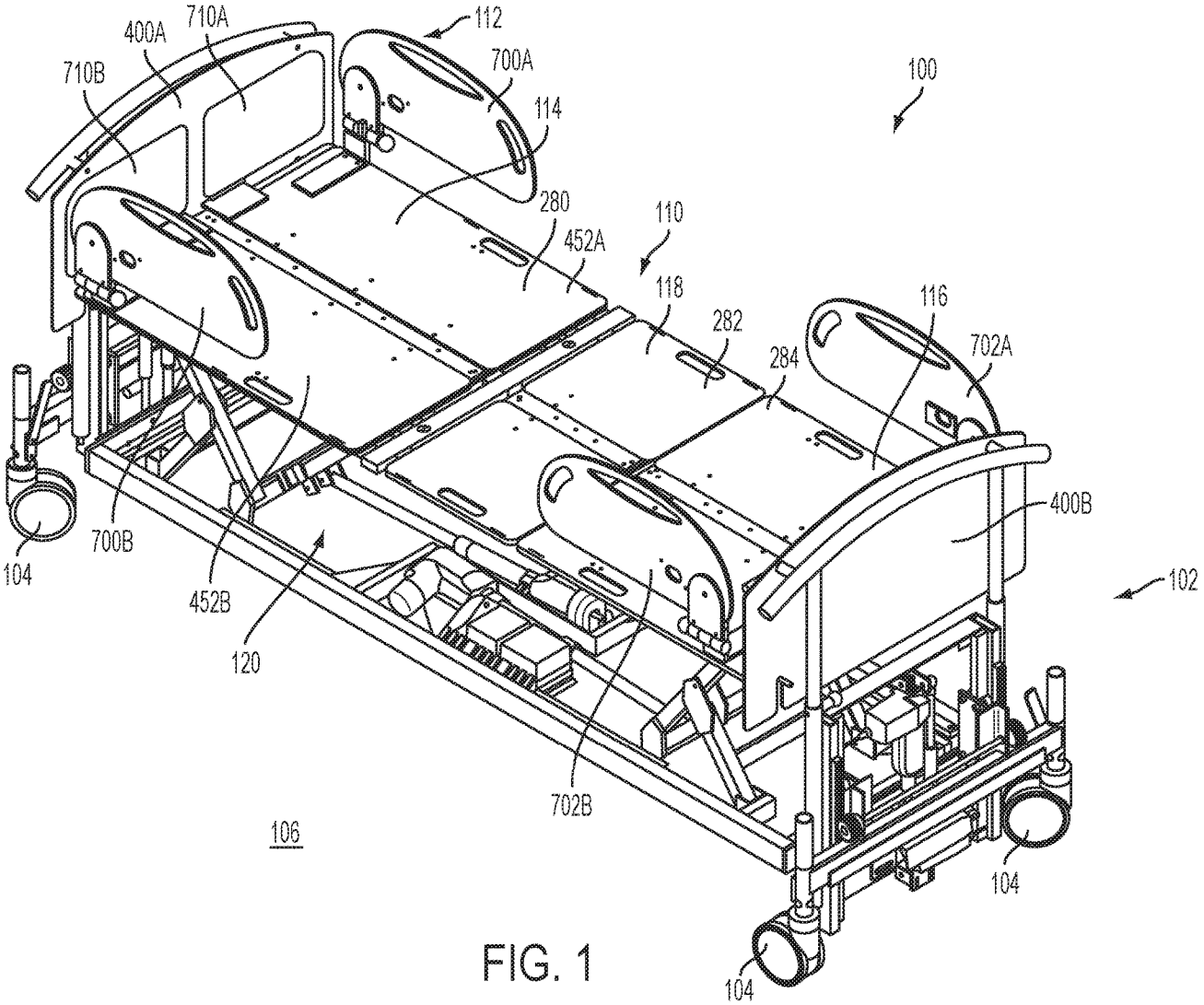
FIG. 1 illustrates a perspective view of an exemplary bed having a lift system, the exemplary bed being shown with the support deck in a raised position.

The embodiments disclosed herein are not intended to be exhaustive or to limit the invention to the precise forms disclosed in the following detailed description. Rather, the embodiments are chosen and described so that others skilled in the art may utilize their teachings.

In an exemplary embodiment of the present disclosure, a bed adapted to be supported on a floor is provided. The bed comprising a plurality of wheels contacting the floor; a headboard and a footboard, a support deck supported by the plurality of wheels, a first lift system supported by the plurality of wheels, and a second lift system supported by the plurality of wheels. The footboard being spaced apart from the headboard. The headboard and the footboard being supported by the plurality of wheels. The support deck including a head end positioned proximate the headboard and a foot end positioned proximate the footboard, and at least one support surface extending between the head end of the support deck and the foot end of the support deck. The first lift system being operatively coupled to the support deck to raise and lower the support deck relative to the plurality of wheels while the plurality of wheels remain in contact with the floor. The second lift system being operatively coupled to the support deck to raise and lower the support deck relative to the plurality of wheels while the plurality of wheels remain in contact with the floor. The second lift system including a lower frame, an upper frame, and a lifting assembly coupled to the lower frame and the upper frame. The second lift system being moveable from an unexpanded configuration wherein the lower frame and the upper frame are separated by a first separation to a first expanded configuration wherein the lower frame and the upper frame are separated by a second separation due to a downward movement of the lower frame relative to the plurality of wheels and a second expanded configuration due to an upward movement of the upper frame relative to the plurality of wheels.

In one example, the first lift system is operatively coupled to the second lift system to raise and lower the second lift system relative to the plurality of wheels while the plurality of wheels remain in contact with the floor. In another example, the first lift system is further configured to raise and lower at least one of the head end of the support deck and the foot end of the support deck independent of the other of the head end of the support deck and the foot end of the support deck and the second lift system is further configured to raise and lower at least one of the head end of the support deck and the foot end of the support deck independent of the other of the head end of the support deck and the foot end of the support deck. In still a further example, the first lift system does not alter the position of the support deck relative to the second lift system as the first lift system raises or lowers the second lift system relative to the plurality of wheels. In yet still another example, the plurality of wheels define a horizontally extending envelope and wherein when viewed from a top view, both of the first lift system and the second lift system are positioned within the horizontally extending envelope defined by the plurality of wheels. In a further example, the second lift system is configured to raise and lower the support deck independently of the first lift system.

In still yet a further example, the second lift system is supported by the first lift system through a plurality of load cells. In a variation thereof, the upper frame of the second lift system is supported by the lower frame of the second lift system and the lower frame of the second lift system is moveably coupled to the plurality of load cells through a plurality of elongated members. In another variation thereof, the plurality of loads cells supports the second lift system through the upper frame of the second lift system when the second lift system is in the unexpanded configuration and the first expanded configuration and wherein the plurality of load cells supports the second lift system through the lower frame of the second lift system when the second lift system is in the second expanded configuration.

In another exemplary embodiment of the present disclosure, a bed adapted to be supported on a floor is provided. The bed comprising a plurality of wheels contacting the floor; a headboard and a footboard, the footboard spaced apart from the headboard, the headboard and the footboard supported by the plurality of wheels; a support deck supported by the plurality of wheels, the support deck including a head end positioned proximate the headboard and a foot end positioned proximate the footboard, and at least one support surface extending between the head end of the support deck and the foot end of the support deck; and a lift system supported by the plurality of wheels. The lift system being operatively coupled to the support deck to raise and lower the support deck relative to the plurality of wheels. The lift system including a head end portion positioned proximate the headboard, a foot end portion positioned proximate the footboard, and a middle portion positioned between the head end portion and the foot end portion. The middle portion having a bottom side relative to the floor, wherein as the lift system raises the support deck from a lowered position to a raised position, the bottom side of the middle portion moves downward. The bottom side of the middle portion remaining the bottom side of the middle portion throughout the movement of the support deck from the lowered position to the raised position.

In one example thereof, the bottom side of the middle portion moves upward prior to moving downward as the lift system raises the support deck from the lowered position to the raised position. In a variation thereof, the lift system includes a first lift system supported by the plurality of wheels and a second lift system supported by the first lift system, the second lift system including a lower frame, an upper frame, and a lifting assembly coupled to the lower frame and the upper frame, the lower frame including the bottom side of the middle portion. In a refinement thereof, as the lift system raises the support deck from the lowered position to the raised position, the second lift system is moved from an unexpanded configuration wherein the lower frame and the upper frame are separated by a first separation to a first expanded configuration wherein the lower frame and the upper frame are separated by a second separation due to a downward movement of the lower frame relative to the plurality of wheels and a second expanded configuration due to an upward movement of the upper frame relative to the plurality of wheels. In another variation thereof, the first lift system is operatively coupled to the second lift system to raise and lower the second lift system relative to the plurality of wheels while the plurality of wheels remain in contact with the floor. In still another variation thereof, the second lift system is configured to raise and lower the support deck independent of the first lift system.

In a further exemplary embodiment of the present disclosure, a method of raising a support deck of a bed having a plurality of wheels supporting the bed relative to a floor is provided. The bed including a lift system supported by a plurality of wheels and operatively coupled to the support deck to raise and lower the support deck relative to the plurality of wheels. The method comprising placing the support deck in a lowered position, wherein a lower portion of the lift system is at a first height from the floor when the support deck is in the lowered position; raising the support deck to a first raised position, wherein the lower portion of the lift system is at a second height from the floor when the support deck is in the first raised position, the second height being higher than the first height; and raising the support deck to a second raised position which is higher than the first raised position, wherein the lower portion of the lift system is at a third height from the floor when the support deck is in the second raised position, the third height being higher than the first height and lower than the second height.

In one example, as the support deck is moved from the lowered position to the second raised position the lift system is spaced apart from the floor. In another example, the support deck remains in a first configuration in the lowered position, the first raised position, and the second raised position. In a further example, the step of raising the support deck to the second raised position includes the steps of: lowering the lower portion of the lift system to the third height; and subsequently raising the support deck to the second raised height. In still another example, the step of raising the support deck to the second raised position includes the steps of: actuating a linear actuator of the lift system; lowering the lower portion of the lift system to the third height during a first travel of the linear actuator; and raising the support deck to the second raised height during a second travel of the linear actuator.

In still another exemplary embodiment of the present disclosure, a bed adapted to be supported on a floor is provided. The bed comprising a plurality of wheels contacting the floor; a headboard and a footboard, the footboard spaced apart from the headboard, the headboard and the footboard supported by the plurality of wheels; a support deck supported by the plurality of wheels, the support deck including a head end positioned proximate the headboard and a foot end positioned proximate the footboard, and at least one support surface extending between the head end of the support deck and the foot end of the support deck; a first lift system supported by the plurality of wheels, the first lift system having a head end positioned proximate the headboard, a foot end positioned proximate the footboard, and a middle portion extending between the head end and the foot end, the first lift system including first means for raising and lowering the support deck; and a second lift system supported by the plurality of wheels, the second lift system having a head end positioned proximate the headboard, a foot end positioned proximate the footboard, and a middle portion extending between the head end and the foot end, the second lift system including second means for raising and lowering the support deck, wherein the second means includes means for adjusting a separation of a lower portion of the second lift system and an upper portion of the second lift system, the means lowers the lower portion of the second lift system and raises the upper portion of the second lift system to increase the separation between the lower portion of the second lift system and the upper portion of the second lift system. In one example, the bed further comprises tensioning means for assisting in reducing the separation between the lower portion of the second lift system and the upper portion of the second lift system. In one variation thereof, the first lift system is operatively coupled to the second lift system to raise and lower the second lift system relative to the plurality of wheels while the plurality of wheels remain in contact with the floor. In another variation thereof, the first lift system is further configured to raise and lower at least one of the head end of the support deck and the foot end of the support deck independent of the other of the head end of the support deck and the foot end of the support deck and the second lift system is further configured to raise and lower at least one of the head end of the support deck and the foot end of the support deck independent of the other of the head end of the support deck and the foot end of the support deck. In another variation thereof, the first lift system does not alter the position of the support deck relative to the second lift system as the first lift system raises or lowers the second lift system relative to the plurality of wheels. In another variation thereof, the plurality of wheels define a horizontally extending envelope and wherein when viewed from a top view, both of the first lift system and the second lift system are positioned within the horizontally extending envelope defined by the plurality of wheels. In another variation thereof, the second lift system is configured to raise and lower the support deck independently of the first lift system In yet still another exemplary embodiment of the present disclosure, a bed adapted to be supported on a floor is provided. The bed comprising a plurality of wheels contacting the floor; a frame supported by the plurality of wheels, the frame having a top surface; a headboard and a footboard, the footboard spaced apart from the headboard, the headboard and the footboard supported by the plurality of wheels; a support deck supported by the plurality of wheels, the support deck including a head end positioned proximate the headboard and a foot end positioned proximate the footboard, and at least one support surface extending between the head end of the support deck and the foot end of the support deck; and a powered drive system coupled to frame. The powered drive system including a drive system frame; a drive wheel coupled to the drive system frame and moveable between a raised position spaced apart from the floor and a lowered position in contact with the floor, a motor operatively coupled to the drive wheel to power a rotation of the drive wheel, a suspension operatively coupled to the drive wheel, the suspension biasing the drive wheel downward in contact with the floor when the drive wheel is in the lowered position while permitting an upward movement of the drive wheel; and a linear actuator operatively coupled to the drive wheel, the linear actuator having a first length to position the at least one drive wheel in the raised position and a second length to position the at least one drive wheel in the lowered position, the linear actuator maintaining a first orientation relative to the top surface of the frame as the drive wheel is moved between the raised position and the lowered position.

In one example, the drive system frame includes a swing arm, the swing arm supporting the drive wheel when the drive wheel is in the raised position. In a variation thereof, the linear actuator engages the swing arm to raise the drive wheel to the raised position. In a refinement thereof, the swing arm includes an elongated slot which receives a member coupled to the linear actuator, the member being positioned within the elongated slot when the drive wheel is in the raised position. In another refinement thereof the swing arm includes an elongated slot which receives a member coupled to the linear actuator, the member being positioned within the elongated slot when the drive wheel is in the raised position and in the lowered position. In a further refinement thereof, the elongated slot has an open end. In still another variation, the swing arm moves independent of the linear actuator when the drive wheel is in the lowered position. In a refinement thereof, the swing arm includes an elongated slot which receives a member coupled to the linear actuator, the member being positioned within the elongated slot when the drive wheel is in the raised position. In another refinement thereof, the swing arm includes an elongated slot which receives a member coupled to the linear actuator, the member being positioned within the elongated slot when the drive wheel is in the raised position and in the lowered position. In a further refinement thereof, the elongated slot has an open end. In yet still a further variation, the suspension biases the swing arm in a downward direction.

In still yet a further exemplary embodiment of the present disclosure, a bed adapted to be supported on a floor is provided. The bed comprising a plurality of wheels contacting the floor; a frame supported by the plurality of wheels; a headboard and a footboard, the footboard spaced apart from the headboard, the headboard and the footboard supported by the plurality of wheels; a support deck supported by the plurality of wheels, the support deck including a head end positioned proximate the headboard and a foot end positioned proximate the footboard, and at least one support surface extending between the head end of the support deck and the foot end of the support deck; and a powered drive system coupled to frame. The powered drive system including a drive unit positioned proximate one of the headboard and the footboard and a drive control unit positioned proximate the other of the headboard and the footboard. The drive unit including a drive wheel moveable between a lowered position in contact with the floor and a raised position spaced apart from the floor. The drive control unit being operatively coupled to the drive unit and including at least one user actuatable input to control at least one movement of the drive unit.

In one example, the drive control unit includes a first user input which causes a rotation of the drive wheel relative to the frame. In another example, the drive control unit includes a second user input which causes the drive wheel to be raised to the raised position. In still another example, the drive control unit includes a third user input which causes the drive wheel to be lowered to the lowered position. In yet still another example, the drive unit includes a drive system frame; a motor operatively coupled to the drive wheel to power a rotation of the drive wheel; a suspension operatively coupled to the drive wheel, the suspension biasing the drive wheel downward in contact with the floor when the drive wheel is in the lowered position while permitting an upward movement of the drive wheel; and a linear actuator operatively coupled to the drive wheel, the linear actuator having a first length to position the at least one drive wheel in the raised position and a second length to position the at least one drive wheel in the lowered position. In a variation thereof, the drive system frame includes a swing arm, the swing arm supporting the drive wheel when the drive wheel is in the raised position. In a refinement thereof, the linear actuator engages the swing arm to raise the drive wheel to the raised position. In a further refinement thereof, the swing arm includes an elongated slot which receives a member coupled to the linear actuator, the member being positioned within the elongated slot when the drive wheel is in the raised position. In another variation, the swing arm includes an elongated slot which receives a member coupled to the linear actuator, the member being positioned within the elongated slot when the drive wheel is in the raised position and in the lowered position. In a refinement thereof, the elongated slot has an open end. In another example, the swing arm moves independent of the linear actuator when the drive wheel is in the lowered position. In a refinement thereof, the swing arm includes an elongated slot which receives a member coupled to the linear actuator, the member being positioned within the elongated slot when the drive wheel is in the raised position. In another refinement thereof, the swing arm includes an elongated slot which receives a member coupled to the linear actuator, the member being positioned within the elongated slot when the drive wheel is in the raised position and in the lowered position. In a further refinement thereof, the elongated slot has an open end. In another variation thereof, the suspension biases the swing arm in a downward direction. In yet another example, the bed further comprises a lift system supported by the plurality of wheels, the lift system operatively coupled to the support deck to raise and lower the support deck relative to the plurality of wheels, the lift system moves the support deck between a first raised position and a first lowered position. In still yet another example, each of the plurality of wheels are caster wheels having a first brake configuration wherein a rotation of the wheel relative to the floor is prevented and a second non-brake configuration wherein the rotation of the wheel relative to the floor is permitted, the placement of the caster wheel in either the first brake configuration or the second non-brake configuration is controlled through a rotation of a mechanical input.

In still a further example, each of the plurality of wheels are caster wheels having a first brake configuration wherein a rotation of the wheel relative to the floor is prevented and a second non-brake configuration wherein the rotation of the wheel relative to the floor is permitted, the placement of the caster wheel in either the first brake configuration or the second non-brake configuration is controlled through a powered caster wheel control system supported by the frame and operatively coupled to at least a first caster wheel of the plurality of caster wheels, the powered caster wheel control system comprising a linear actuator; and a mechanical linkage driven by the linear actuator and operatively coupled to a mechanical input of the first caster wheel, the mechanical linkage having a first configuration which places the mechanical input in the first brake configuration, a second configuration which places the mechanical input in the second non-brake configuration, and a third neutral configuration.

Referring to FIG. 1, an exemplary bed 100 is shown. Bed 100 includes a bed frame 102 supported by a plurality of wheels 104 which are supported on a floor 106 of the environment. The bed frame 102 supports a support deck 110 and a plurality of barrier components which form a barrier 112 around the support deck 110. The support deck 110 in turn supports a patient support (not shown).

Exemplary patient supports include mattresses, foam support members, inflatable support members, and other support members that would provide comfort to a patient positioned on the patient support. In one embodiment, the patient support may provide one or more therapies to the patient supported on the patient support. Exemplary therapies include a turning therapy, an alternating pressure therapy, a percussion therapy, a massaging therapy, a low air loss therapy, and other suitable types of therapy. Exemplary patient supports and their operation are provided in U.S. Pat. No. 7,454,809, filed on Dec. 26, 2006, Ser. No. 11/616,127, titled METHOD FOR USING INFLATABLE CUSHION CELL WITH DIAGONAL SEAL STRUCTURE; US Published Patent Application No. 2008/0098532, Ser. No. 11/553,405, filed Oct. 26, 2006, titled MULTI-CHAMBER AIR DISTRIBUTION SUPPORT SURFACE PRODUCT AND METHOD; and U.S. Provisional Patent Application No. 61/713,856, filed Oct. 15, 21012, titled PATIENT SUPPORT APPARATUS AND METHOD, the disclosures of which are expressly incorporated by reference herein.

In the illustrated embodiment, support deck 110 is an expandable support deck. Additional details regarding the expandable support deck are provided in U.S. patent application Ser. No. 14/208,987, titled BED SYSTEMS AND METHOD, filed Mar. 13, 2014, the disclosure of which is expressly incorporated by reference herein.

In the illustrated embodiment, bed frame 102 includes a lift system 120. Lift system 120 is configured to raise and lower support deck 110 relative to the wheels 104 and hence relative to floor 106. In one embodiment, lift system 120 is configured to move support deck 110 between a raised position having a first clearance from the floor and a lowered position having a second clearance from the floor, the second clearance being less than the first clearance. In one example, the first clearance is up to about 34 inches from the floor and the second clearance is up to about 12 inches from the floor. In another example, the first clearance is up to about 34 inches from the floor and the second clearance is up to about 10 inches from the floor. In a further example, the first clearance is at least about 34 inches from the floor and the second clearance is up to about 8 inches from the floor. In a still further example, the first clearance is at least 34 inches from the floor and the second clearance is up to about 6 inches from the floor. In yet still a further example, the first clearance is at least 34 inches from the floor and the second clearance is up to about 7 inches from the floor. In still another example, the first clearance is at least 34 inches from the floor and the second clearance is generally equal to a diameter of the plurality of wheels 104. In yet still a further example, the first clearance is up to about 30 inches from the floor and the second clearance is up to about 6 inches from the floor. In one embodiment, in all of the examples provided above, the bed frame 102 remains spaced apart from floor 106 when the support deck is in the lowered position thus permitting bed 100 to be moveable relative to floor 106.

Figure 2:
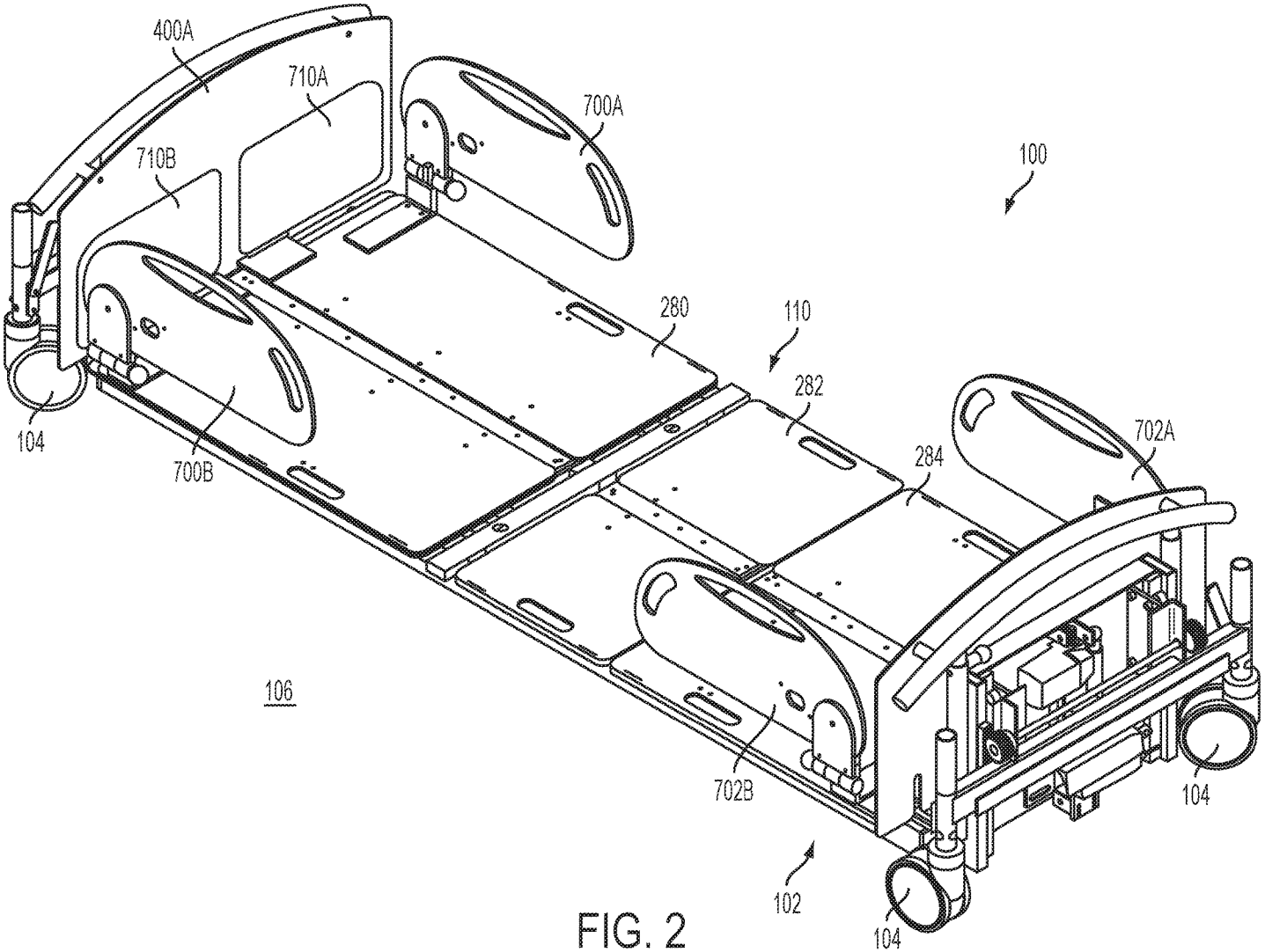
FIG. 2 illustrates a perspective view of the bed of FIG. 1 with the support deck being shown in a lowered position.

FIG. 1 illustrates bed 100 in an exemplary raised position and FIG. 2 illustrates bed 100 in an exemplary lowered position. As explained in more detail herein, the support deck 110 of bed 100 is an articulating support deck. The support deck 110 retains both its ability to articulate and expand when bed 100 is in the lowered position of FIG. 2. The support deck 110 includes a first set of head end siderails 700A, 700B, a second set of foot end siderails 702A, 702B, and a plurality of head end barrier components 710A, 710B. Head end barrier component 710A is pivotally coupled to first side plate 452A and head end barrier component 710B is pivotally coupled to second side plate 452B.

Figure 3:
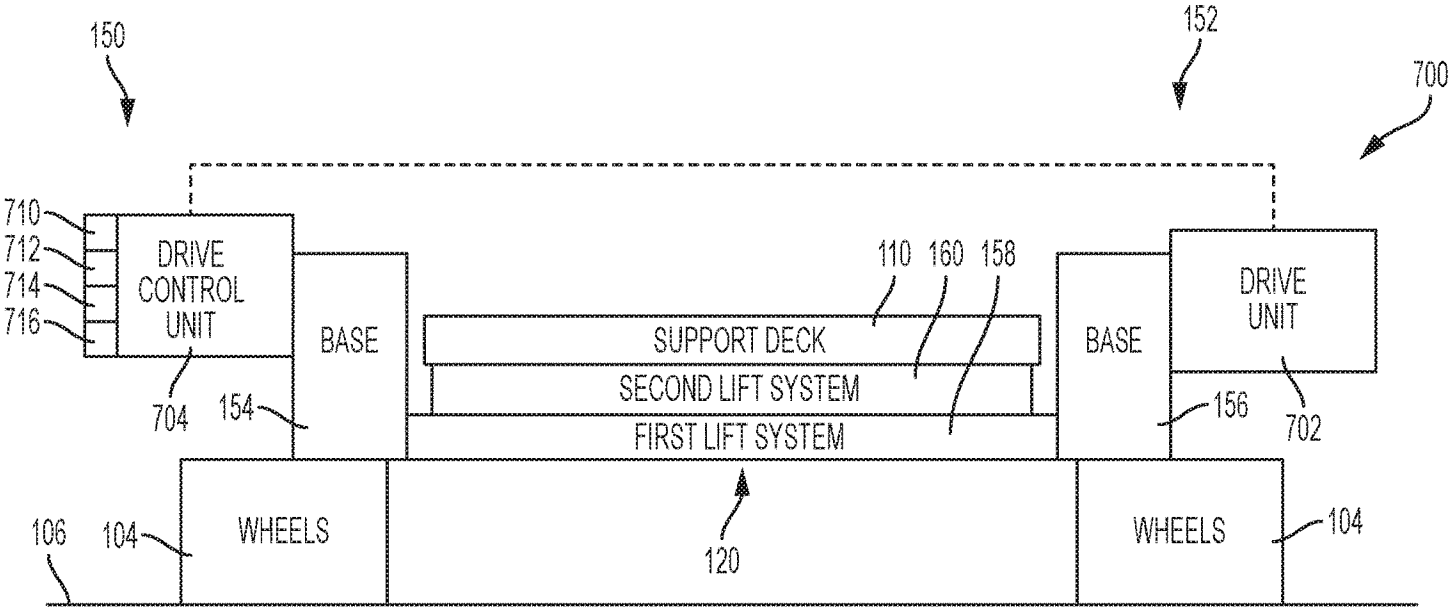
FIG. 3 illustrates a respective view of the components of the bed of FIG. 1.

Referring to FIG. 3, an exemplary representation of bed 100 is shown. Bed 100 includes a head end 150 and a foot end 152. The plurality of wheels 104 sit on the floor 106. A head end set of wheels 104 supports a first base 154 and a foot end set of wheels 104 supports a second base 156. Lift system 120 includes a plurality of lift systems. A first lift system 158 is coupled to base 154 on a head end of first lift system 158 and to base 156 on a foot end of first lift system 158. A second lift system 160 is coupled to first lift system 158. Support deck 110 is supported by second lift system 160. In operation, each of first lift system 158 and second lift system 160 may be individually actuatable. As such, first lift system 158 may be actuated to raise or lower support deck 110 while second lift system 160 remains static, but is also being raised or lowered. Further, second lift system 160 may be actuated to raise or lower support deck 110 while first lift system 158 remains static. In addition, both first lift system 158 and second lift system 160 may both be actuated simultaneously to raise or lower support deck 110.

Figure 4:
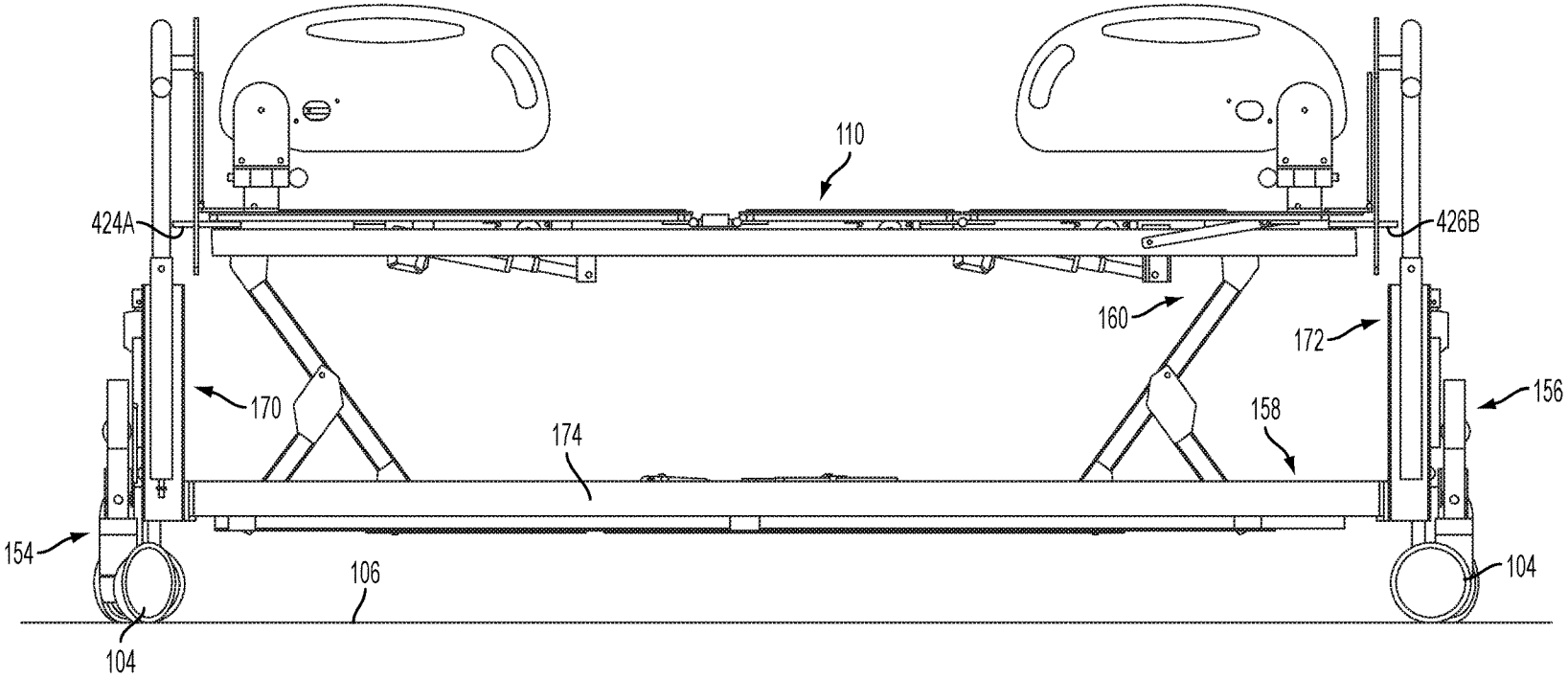
FIG. 4 illustrates a side view of the bed of FIG. 1 with the support deck in the raised position as in FIG. 1.
Figure 6:
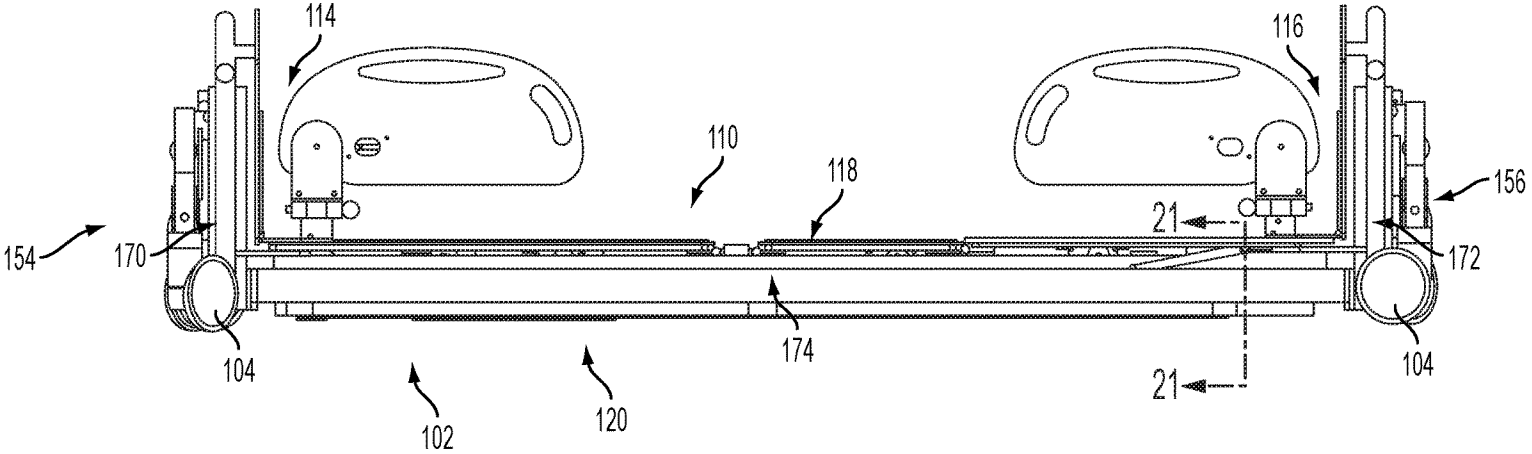
FIG. 6 illustrates a side view of the bed of FIG. 1 with the support deck in the lowered position as in FIG. 2.

Referring to FIG. 4, bed 100 is shown in the raised position of FIG. 1. In the illustrated embodiment, first lift system 158 includes a head end base 170, a foot end base 172, and a middle portion 174 extending between head end base 170 and foot end base 172. As shown by a comparison of FIGS. 4 and 6, head end base 170 may be raised or lowered relative to first base 154 and foot end base 172 may be raised or lowered relative to second base 156. In FIGS. 3 and 6, head end base 170 and foot end base 172 are both raised or lowered relative to their respective first base 154 and second base 156 together resulting in a head end 114 of support deck 110 and a foot end 116 of support deck 110 remaining generally even such that an upper support surface 118 of support deck 110 remains generally horizontal.

Figure 7:
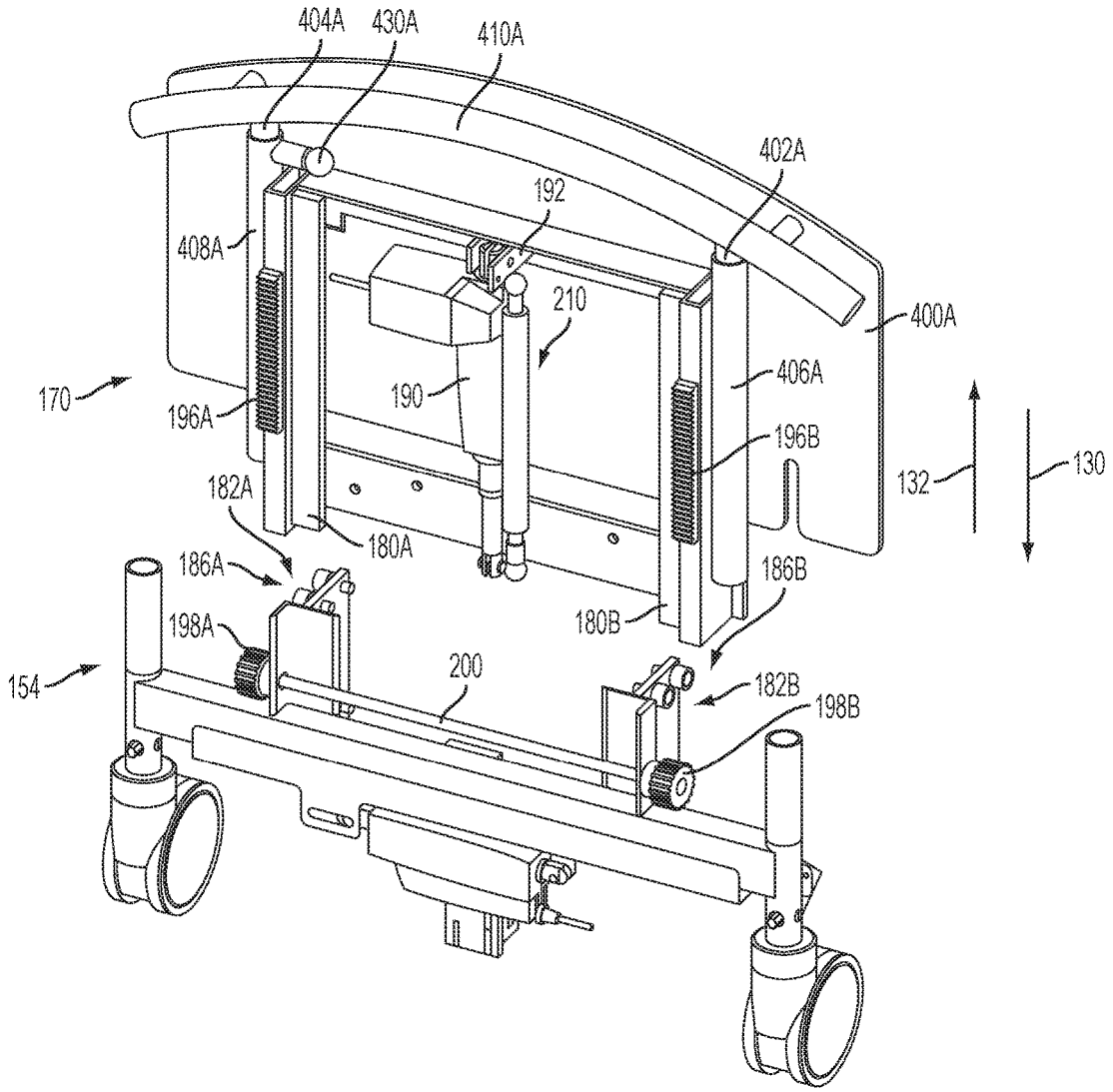
FIG. 7 illustrates a perspective view of a head end portion of the bed of FIG. 1 illustrating a first base of the frame of the bed and a head end portion of a first lift system of the bed, the first lift system being disassembled from the first base.

Referring to FIGS. 5 and 7-9, the connection between first base 154 and head end base 170 is shown. Referring to FIG. 7, head end base 170 includes rails 180A, 180B which are received in respective channels 182A, 182B of first base 154. The channels 182A, 182B includes rollers 186A, 186B. The interaction between rails 180A, 180B and the respective channels 182A, 182B generally limits the movement of head end base 170 relative to first base 154 in direction 130 and direction 132. FIG. 7 also shows endboard 400A, tube 402A which is slidable within tube 406A, tube 404A which is slidable within tube 408A, push bar 410A, and retainer 430A.

Figure 5:
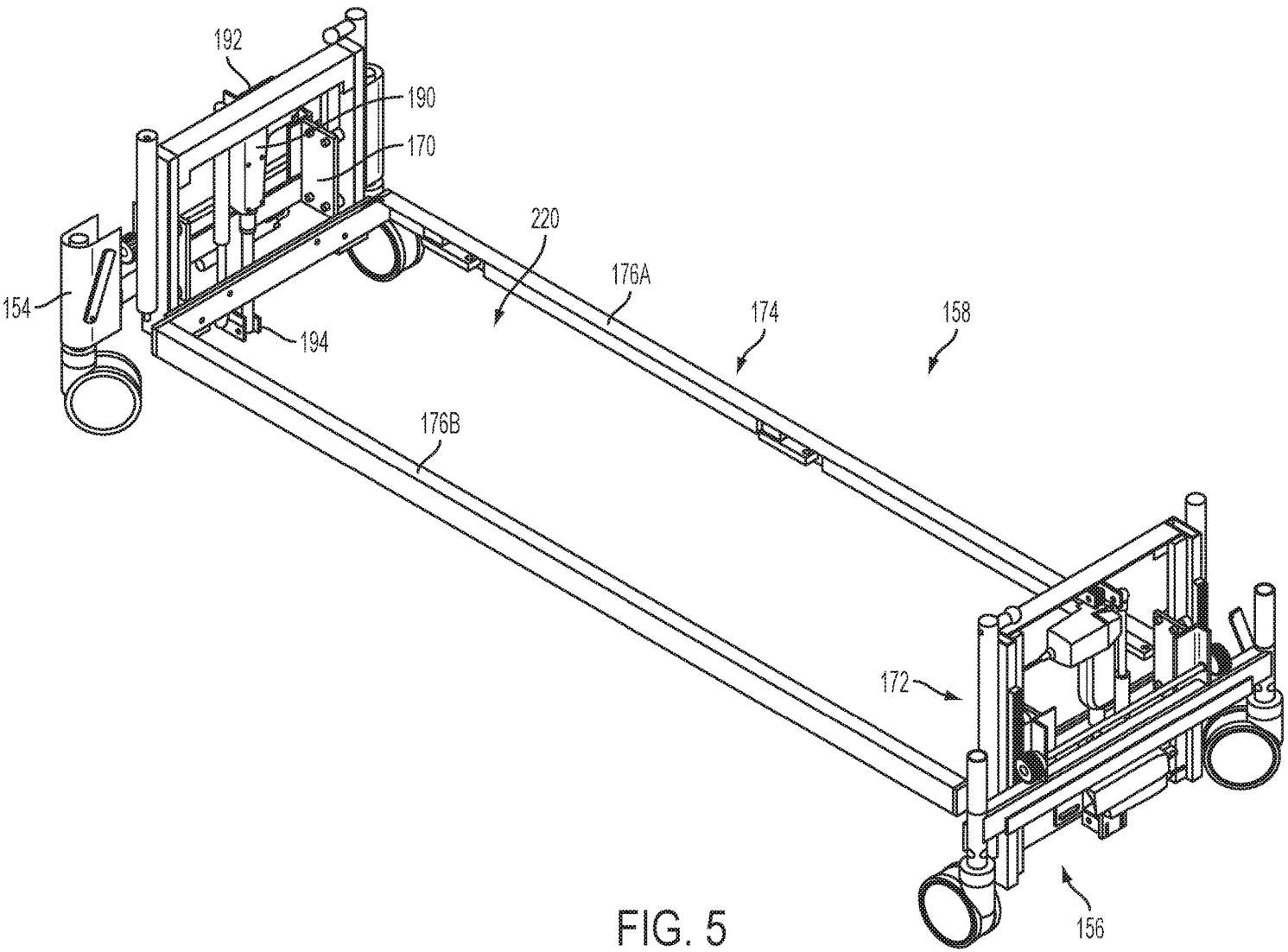
FIG. 5 is a perspective view of a first lift system of the bed of FIG. 1.

A linear actuator 190 is coupled to head end base 170 at bracket 192 and first base 154 at bracket 194 (see FIG. 5). Linear actuator 190 is mounted generally vertical to increase its vertical lifting force without the use of levers. To compensate for off center loading of support deck 110 and to maintain an orientation of head end base 170 relative to first base 154, head end base 170 includes rack gears 196A, 196B which interact with respective pinion gears 198A, 198B of first base 154. Pinion gears 198A, 198B are coupled together through an axle 200 which keeps pinion gears 198A, 198B rotating at the same rate and in turn keeps head end base 170 aligned with first base 154.

Referring to FIG. 7, in one embodiment, a gas spring 210 is included to assist in raising head end base 170 relative to first base 154. A first end of gas spring 210 is coupled to head end base 170 and a second end of gas spring 210 is coupled to first base 154. Gas spring 210 is compressed when head end base 170 is moved in direction 130 and assists in lifting head end base 170 in direction 132 when head end base 170 is being raised. Gas spring 210 also reduces the speed at which support deck 110 moves in direction 130 in case of failure of the actuator.

Figure 8:
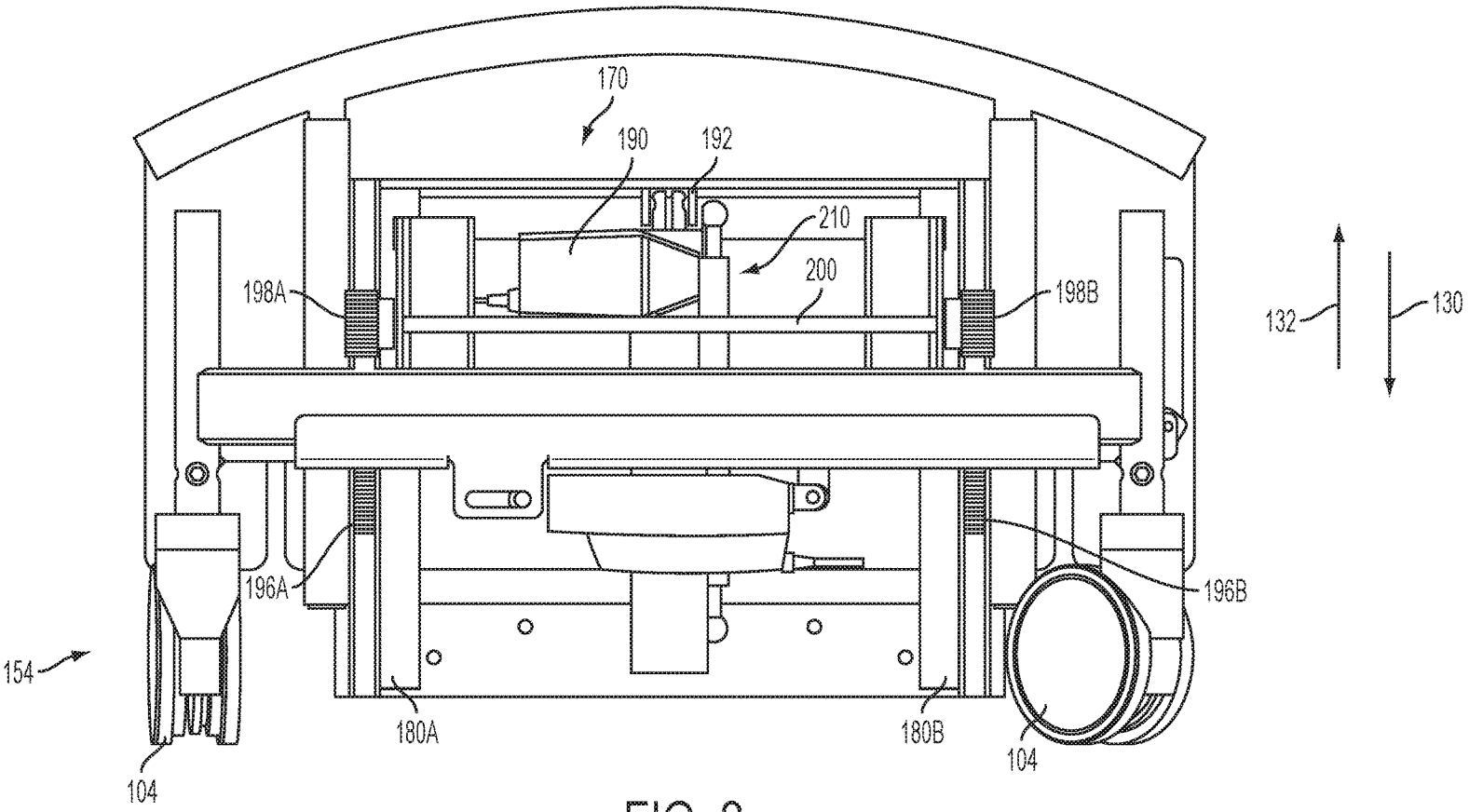
FIG. 8 illustrates a head end view of the assembly of FIG. 7 with the head end portion of the first lift system coupled to the first base and the head end portion of the first lift system being in the lowered position shown in FIG. 2.
Figure 9:
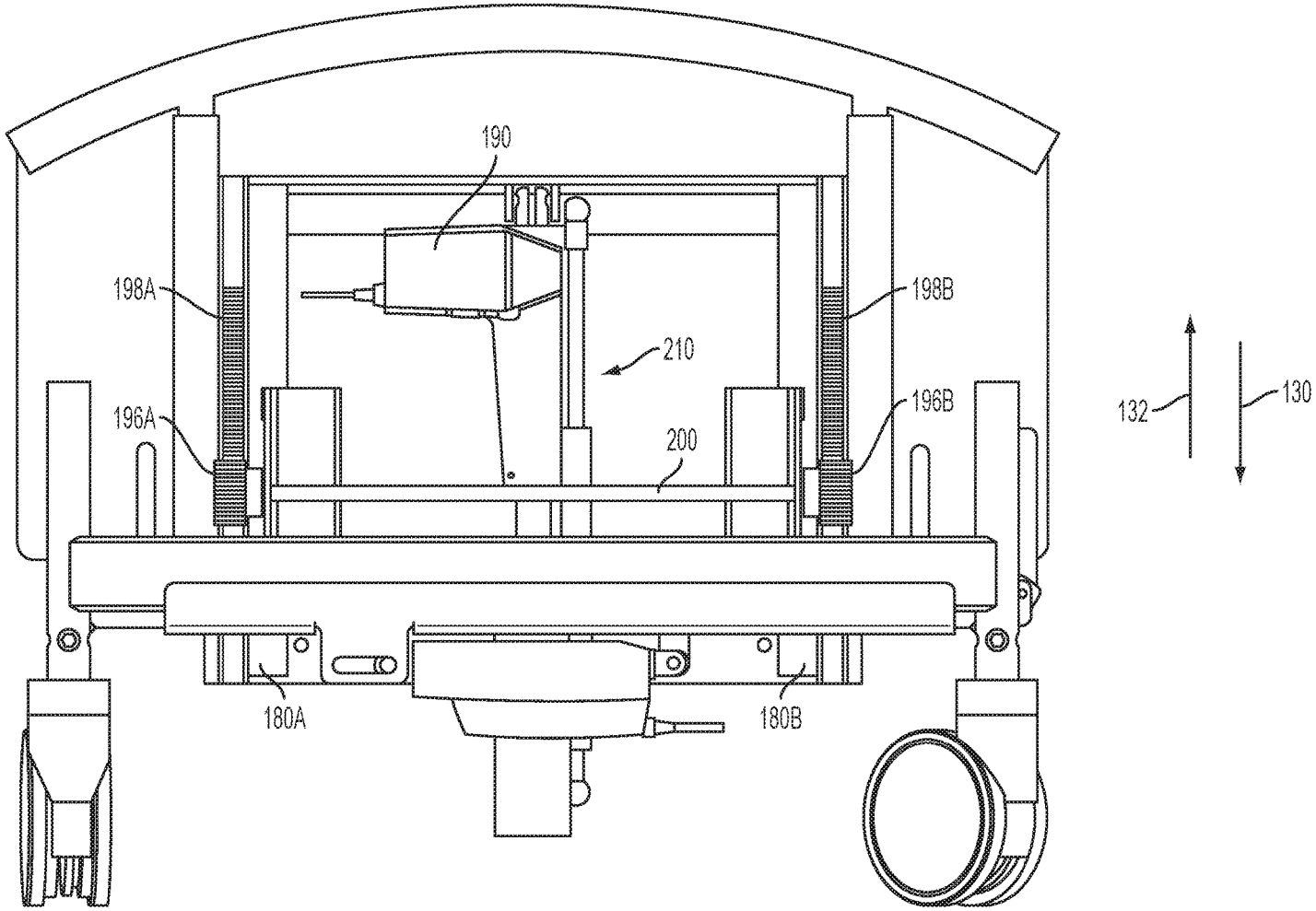
FIG. 9 illustrates a head end view of the assembly of FIG. 7 with the head end portion of the first lift system coupled to the first base and the head end portion of the first lift system being in the raised position shown in FIG. 1.

Referring to FIG. 8, head end base 170 is lowered in direction 130 relative to first base 154. Referring to FIG. 9, head end base 170 is raised in direction 132 relative to first base 154. As shown in FIGS. 8 and 9, linear actuator 190 is centered between racks 196A, 196B. Although a single linear actuator 190 is shown, multiple linear actuators 190 may be used to increase the lifting force in direction 132. If multiple linear actuators 190 are included, the linear actuators 190 may replace the rack and pinion arrangement. However, the multiple linear actuators 190 would require synchronizing when expanding or retracting.

As mentioned herein, by incorporating the rack and pinion arrangement, the stability of bed 100 is increased. The pinion gears 198A, 198B are fixed to axle 200 which is mounted horizontally across first base 154. The pinion gears 198A, 198B ride up in direction 132 and/or down in direction 130 relative gear racks 196A, 196B that are mounted vertically to vertical portions of head end base 170. When a load upon support deck 110 is off center the load is evenly distributed and/or balanced across the pinion gear axle 200 from one pinion gear 198 to the other pinion gear 198 maintaining the parallelism of first base 154 and head end base 170. foot end base 172 and second base 156 are connected further a rack and pinion arrangement like head end base 170 and first base 154 and is driven by a linear actuator like head end base 170 and first base 154.

Figure 10:
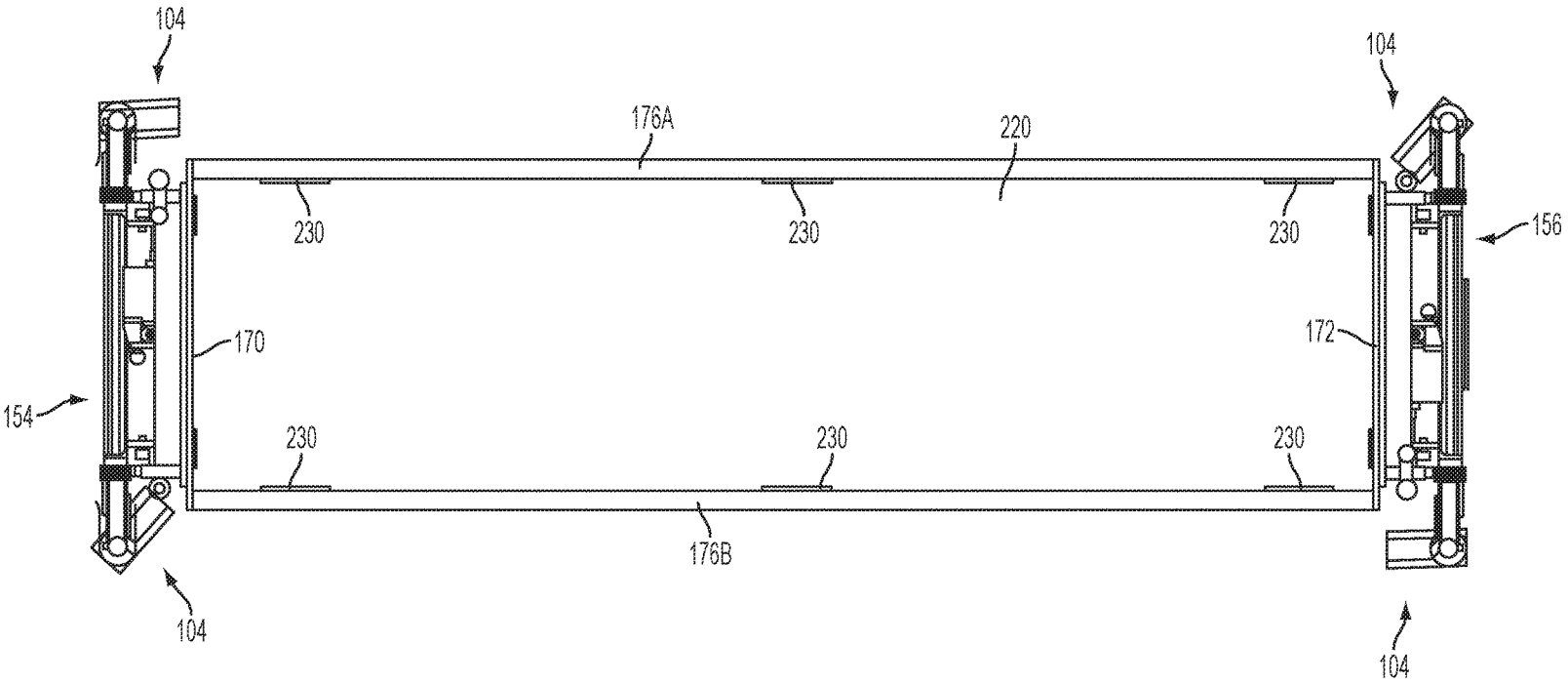
FIG. 10 illustrates a top view of the first lift system of FIG. 5.

Referring to FIG. 5, middle portion 174 includes two horizontally extending members 176A, 176B that are coupled to head end base 170 at a head end and are coupled to foot end base 172 at a foot end. Head end base 170, member 176A, foot end base 172, and member 176B bound an open area 220 in first lift system 158. As shown in FIG. 10, the open area 220 is generally rectangular in shape.

Figure 21:
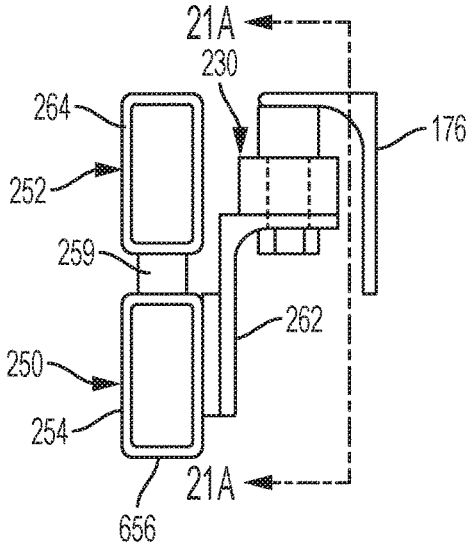
FIG. 21 is a sectional view of portions of the first lift system and the second lift system along lines 21-21 in FIG. 6.
Figure 21A:
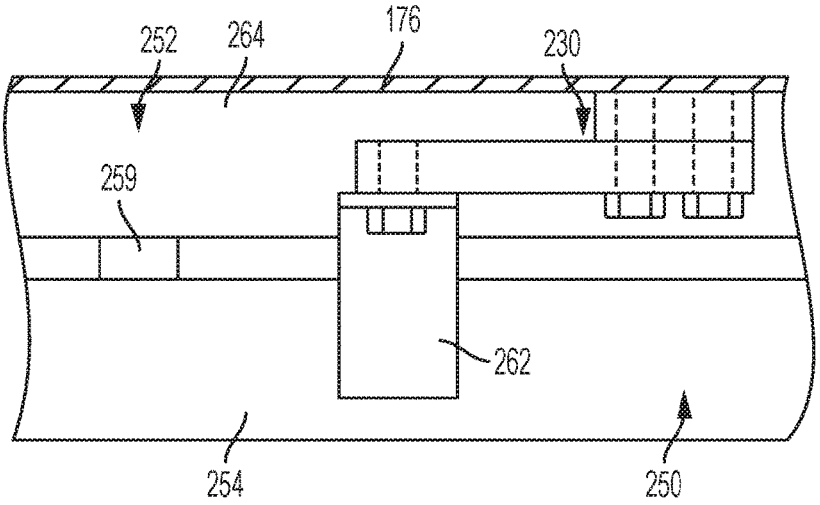
FIG. 21A is a view of portions of the first lift system and the second lift system along direction A in FIG. 21.

First lift system 158 supports a plurality of load cells 230 (see FIGS. 10 and 21). Six load cells 230 are illustrated. More or fewer load cells 230 may be used. An exemplary load cell is a BK2 500 kg load cell available from Flintec Load Cells located at 18A Kane Industrial Drive in Hudson, Mass. 01749.

Second lift system 160 is also coupled to load cells 230 (see FIGS. 10 and 21). Second lift system 160 is coupled to first lift system 158 through load cells 230. As mentioned herein, support deck 110 is supported by second lift system 160. As such, by monitoring the load cells 230, a weight of second lift system 160, support deck 110, and items supported on support deck 110 may be determined as is known in the art.

Figure 11:
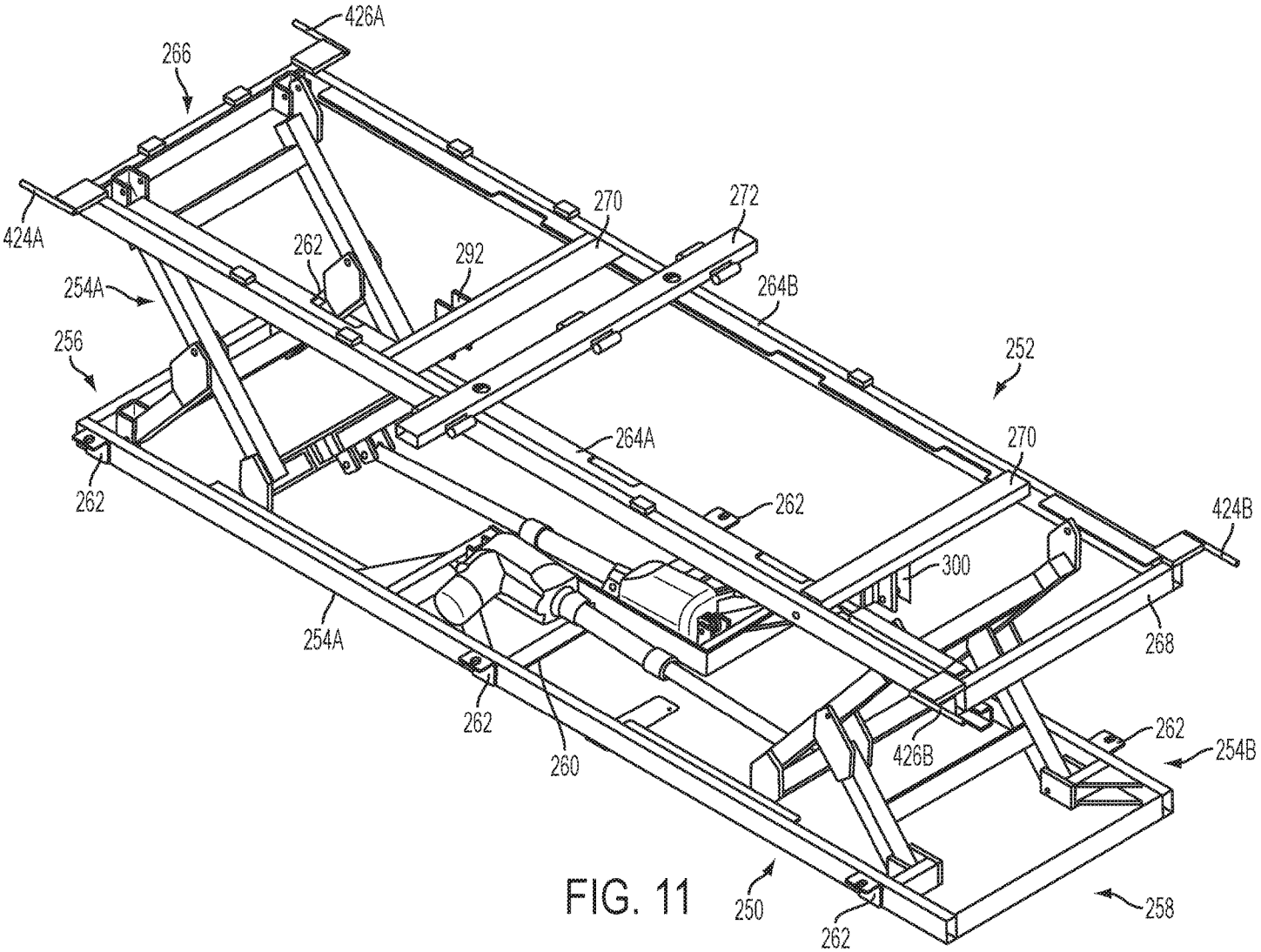
FIG. 11 illustrates a perspective view of a second lift system of the bed with the second lift system in the raised configuration shown in FIG. 1.
Figure 12:
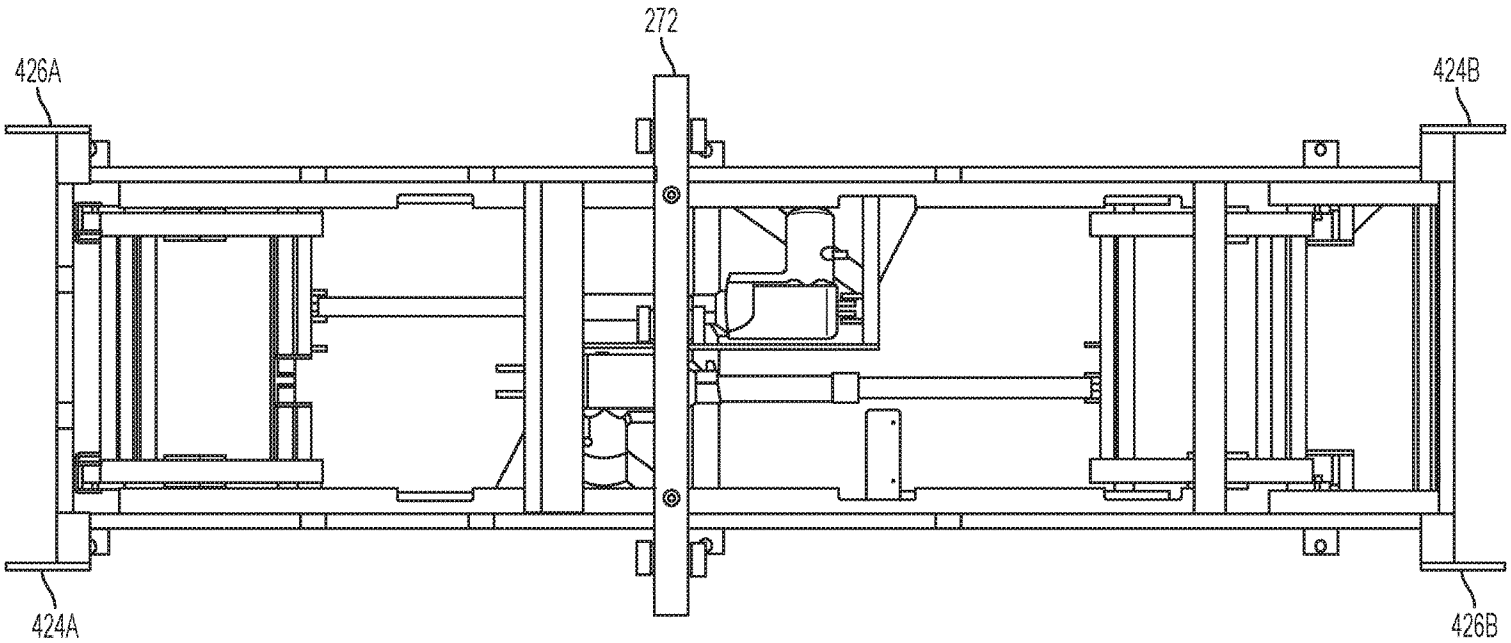
FIG. 12 illustrates a top view of the second lift system in the raised configuration of FIG. 11.
Figure 13:
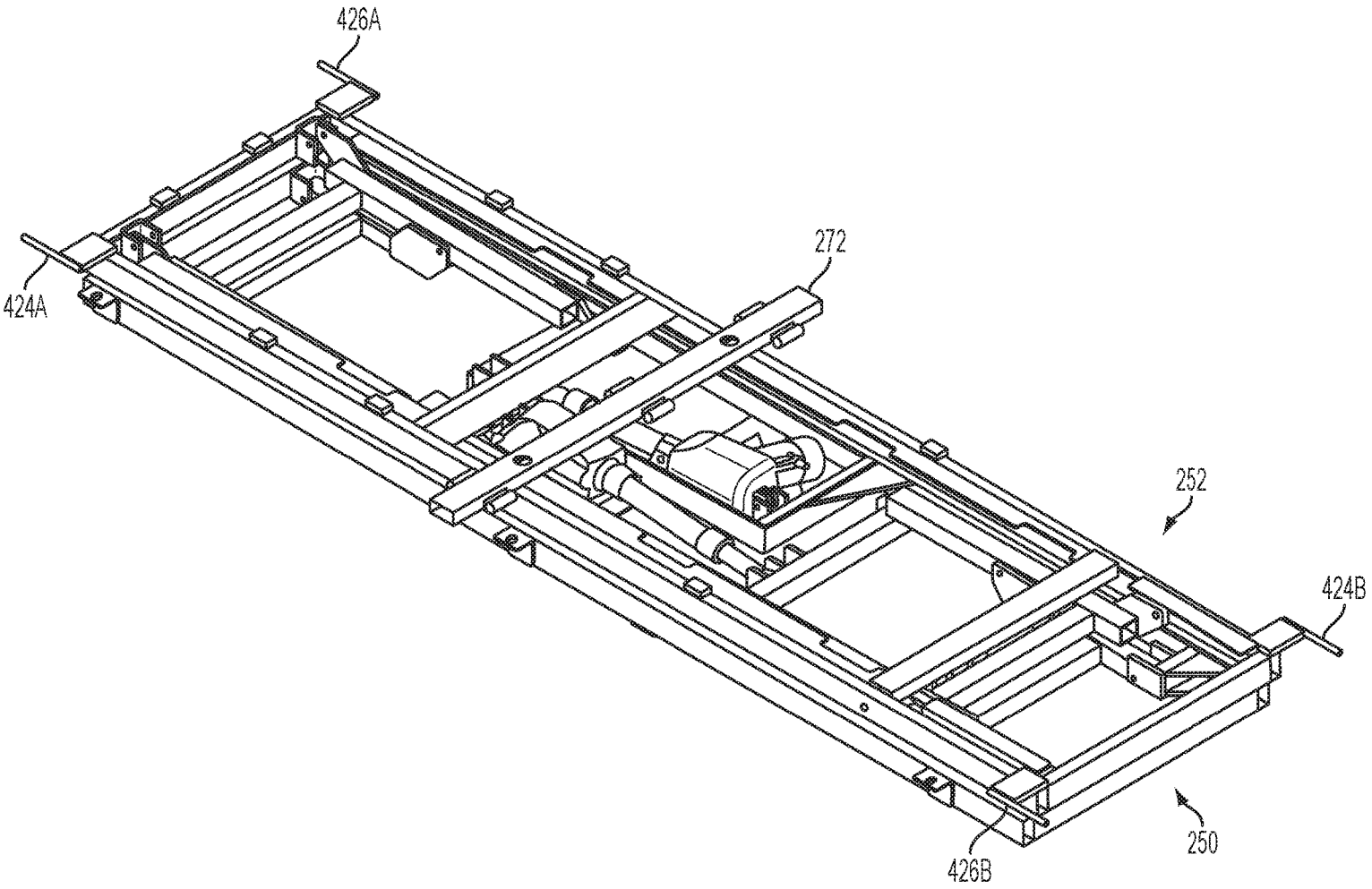
FIG. 13 illustrates a perspective view of a second lift system of the bed with the second lift system in the lowered configuration shown in FIG. 2.
Figure 14:
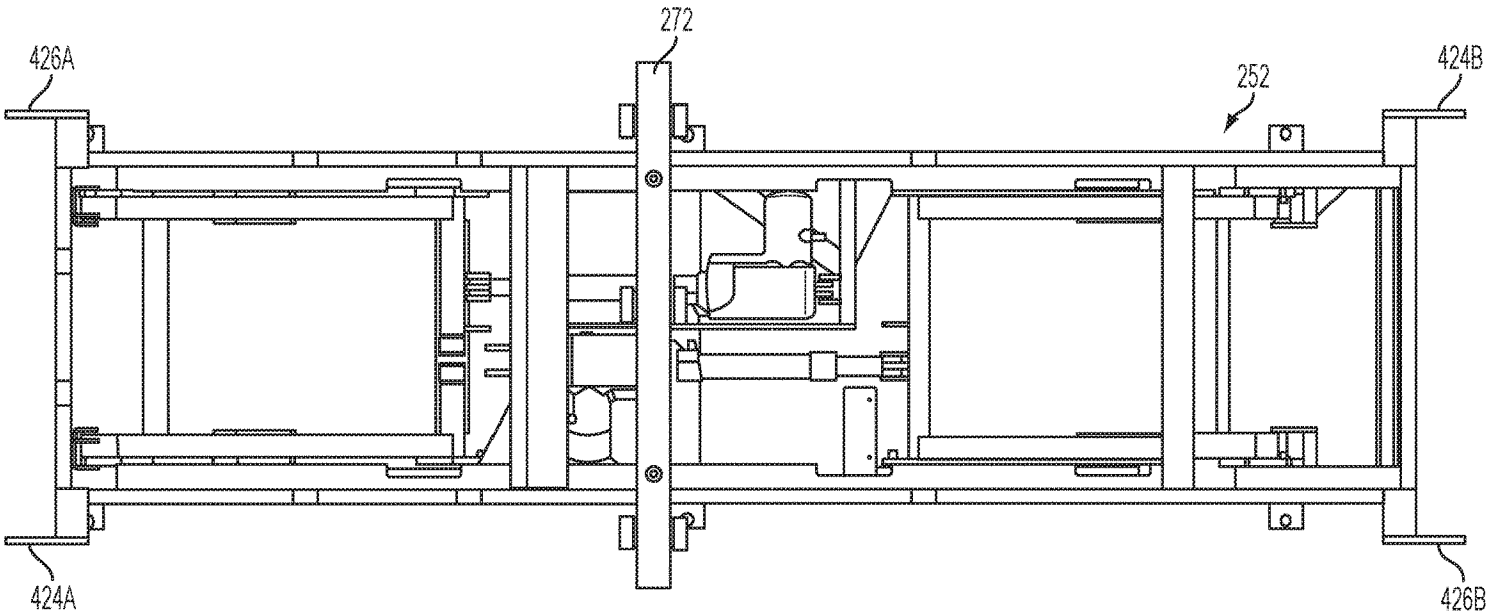
FIG. 14 illustrates a top view of the second lift system in the lowered configuration of FIG. 13.

Referring to FIGS. 11 and 12, an exemplary embodiment of second lift system 160 is shown in a first raised configuration. The illustrated embodiment of second lift system 160 is also shown in FIGS. 13 and 14 in a first lowered configuration.

Returning to FIG. 11, second lift system 160 includes a lower frame 250, an upper frame 252 and lifting assemblies 254A, 254B. Lower frame 250 includes a pair of longitudinally extending members 254A, 254B which extend from a head end to a foot end. Lower frame 250 further includes a head end cross member 256, a foot end cross member 258, and a mid cross member 260. Lower frame 250 further includes a plurality of brackets 262 which couple second lift system 160 to load cells 230.

Upper frame 252 includes a pair of longitudinally extending members 264A, 264B which extend from a head end to a foot end. Upper frame 252 further includes a head end cross member 266, a foot end cross member 268, and a plurality of mid cross members 270. Upper frame 252 further includes a cross member 272 which is pivotally coupled to support deck 110. Moreover, upper frame 252 includes a first pin 424A and a second pin 426A.

Referring to FIG. 21, one of load cells 230 is illustrated coupled to longitudinally extending member 176 of first lift system 158. Load cell 230 is further illustrated as coupled to longitudinally extending member 254 of lower frame 250 of second lift system 160 through bracket 262. As shown in FIG. 21, the relative position of lower frame 250 and longitudinally extending member 176 is fixed while upper frame 252 may be raised relative to lower frame 250 to raise support deck 110 relative to floor 106. A stop member 259 is also illustrated in FIG. 21. Stop member 259 maintains a minimum separation between frame member 254 of lower frame 250 and frame member 264 of lower frame 250. In one embodiment, multiple stop member 259 are provided at spaced apart locations between frame member 254 of lower frame 250 and frame member 264 of lower frame 250.

Figure 15:
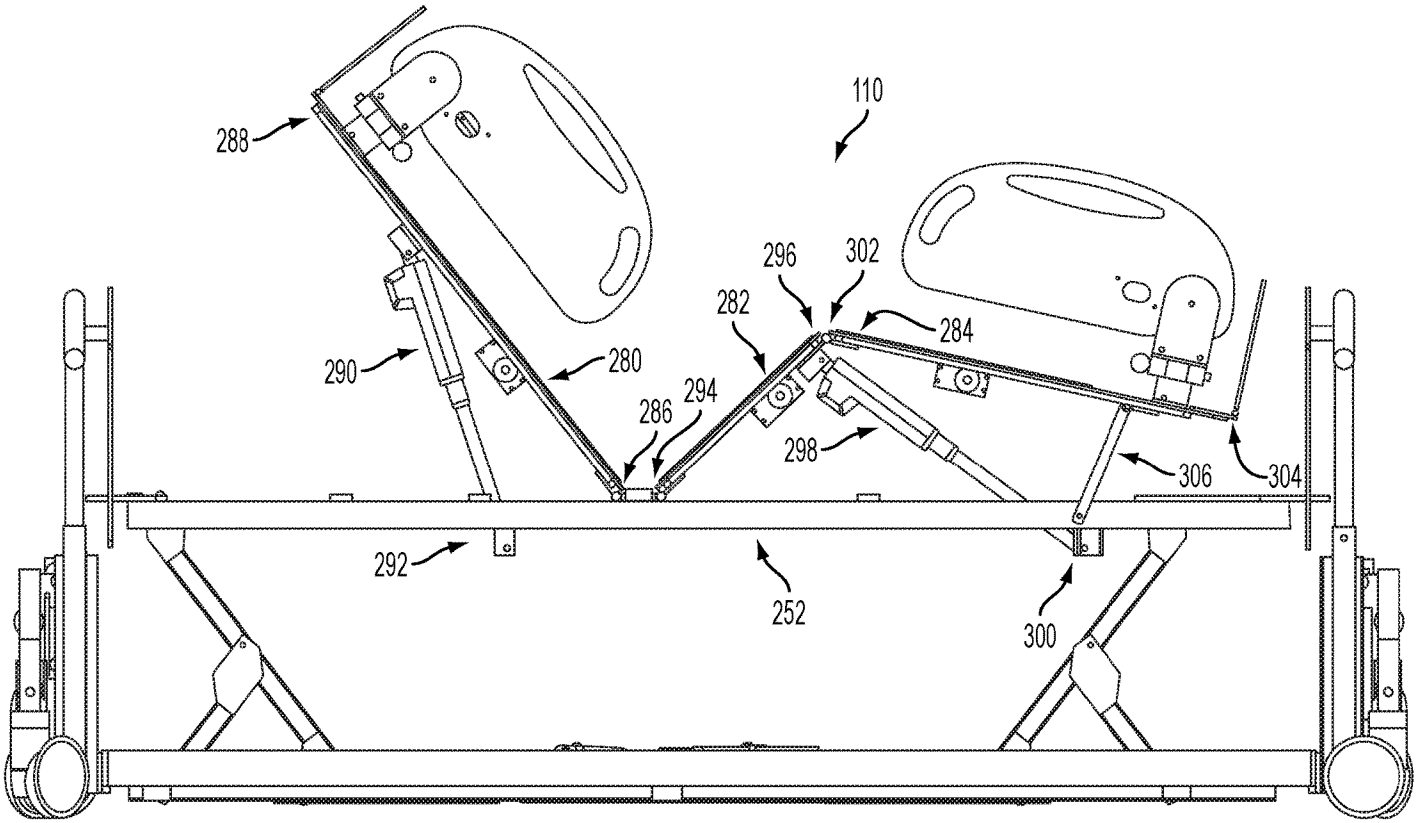
FIG. 15 illustrates the side view of the bed in FIG. 4 with the support deck articulated in a non-horizontal configuration.
Figure 16:
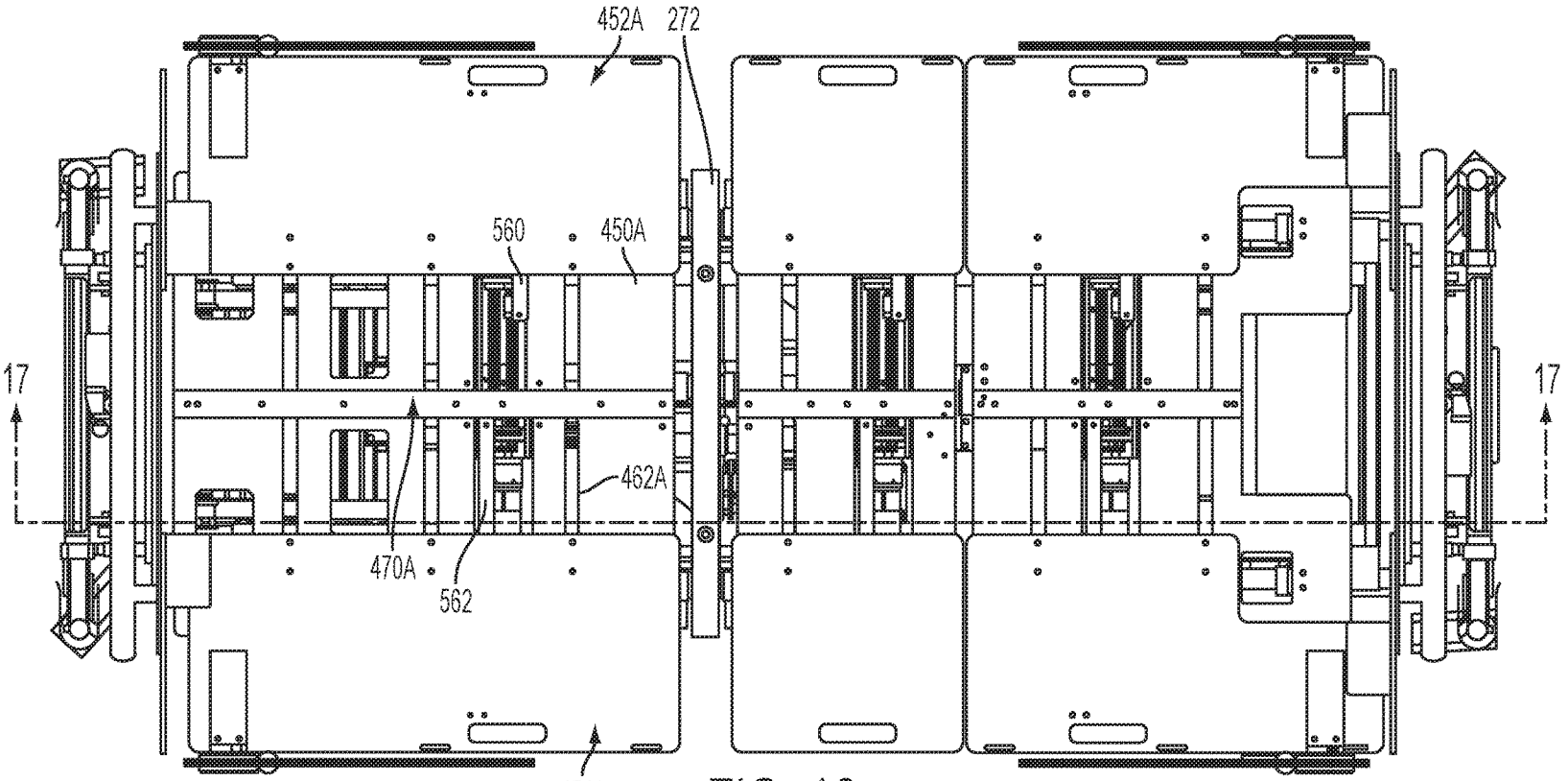
FIG. 16 illustrates a top view of the bed in the configuration of FIG. 2 and with the support deck in an expanded configuration.

As shown in FIG. 15, support deck 110 includes a plurality of sections which may be articulated relative to upper frame 252. Support deck 110, in the illustrated embodiment, includes a head section 280, a seat section 282, and a foot section 284. Head section 280 is pivotally coupled to cross member 272 at a first end 286. A second end 288 of head section 280 is raised relative to first end 286 with a linear actuator 290 pivotally coupled to head section 280 and pivotally coupled to a bracket 292 on upper frame 252. Seat section 282 is pivotally coupled to cross member 272 at a first end 294. A second end 296 of seat section 282 is raised relative to first end 294 with a linear actuator 298 pivotally coupled to seat section 282 and pivotally coupled to a bracket 300 on upper frame 252. Leg section 284 is pivotally coupled to seat section 282 at a first end 302. A second end 304 of leg section 284 is pivotally coupled to upper frame 252 through a link 306. Exemplary linear actuators 290 and 298 are LA31 available from Linak U.S. Inc. located at 2200 Stanley Gault Parkway in Louisville Ky. 40223. FIG. 16 shows a central plate 450A, a first side plate 452A, a second side plate 454A, links 560, 562, slot 462A, and central support 470A.

Figure 19:
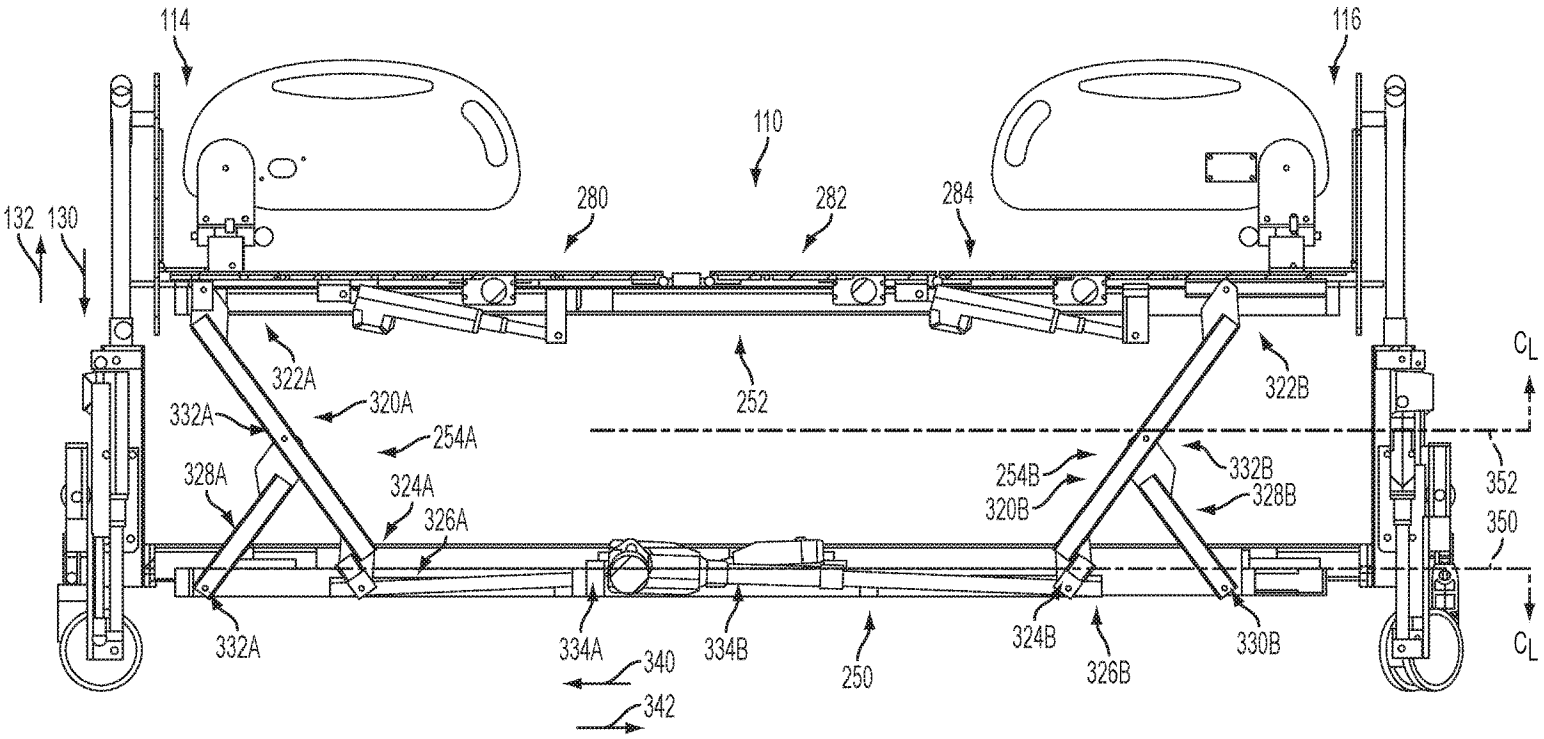
FIG. 19 is a sectional view of the bed along lines 19-19 in FIG. 18.

In the illustrated embodiment, lifting assemblies 254A, 254B are generally identical. Referring to FIG. 19, lifting assembly 254A is a scissor jack assembly. Lifting assembly 254A includes a first leg 320A pivotally coupled to upper frame 252 on a first end 322A and both pivotally and slidably coupled to lower frame 250 on a second end 324A. The second end 324A of first leg 320A includes a member that cooperates with guide 326A to permit second end 324A to move horizontally in direction 340 and in direction 342. An exemplary member is a roller received in a guide channel. Lifting assembly 254A further includes a second leg 328A pivotally coupled to lower frame 250 on a first end 330A and pivotally coupled to first leg 320A on a second end 332A. Similarly, lifting assembly 254B includes a first leg 320B pivotally coupled to upper frame 252 on a first end 322B and both pivotally and slidably coupled to lower frame 250 on a second end 324B. The second end 324B of first leg 320B includes a member that cooperates with guide 326B. Lifting assembly 254A further includes a second leg 328B pivotally coupled to lower frame 250 on a first end 330B and pivotally coupled to first leg 320B on a second end 332B.

The second end 324A of first leg 320A is coupled to a linear actuator 334A. Exemplary linear actuators 290 and 298 are LA 34 available from Linak U.S. Inc. located at 2200 Stanley Gault Parkway in Louisville Ky. 40223. The linear actuator 334A may be actuated to move second end 324A in direction 340 to raise head end 114 of support deck 110 in direction 132 and may be actuated to move second end 324A in direction 342 to lower head end 114 of support deck 110 in direction 130.

Figure 20:
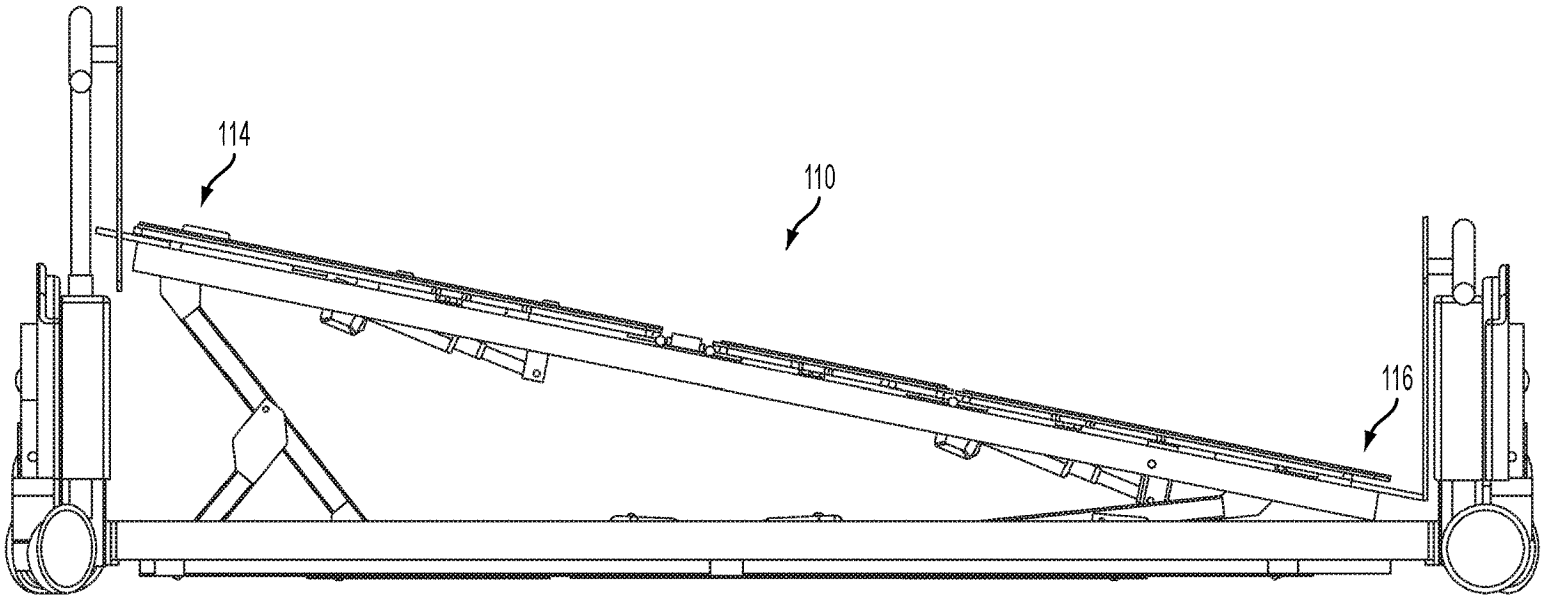
FIG. 20 is a side view of the bed of FIG. 1 wherein a foot end of the support deck is lowered relative to a head end of the support deck.

In a similar manner linear actuator 334B may be actuated to move second end 324B in direction 342 to raise foot end 116 of support deck 110 in direction 132 and may be actuated to move second end 324B in direction 340 to lower foot end 116 of support deck 110 in direction 130. Referring to FIG. 4, lifting assembly 254A and lifting assembly 254B are actuated to raise both head end 114 of support deck 110 and foot end 116 of support deck 110. Referring to FIG. 20, lifting assembly 254B is actuated to lower foot end 116 of support deck 110.

Figure 17:
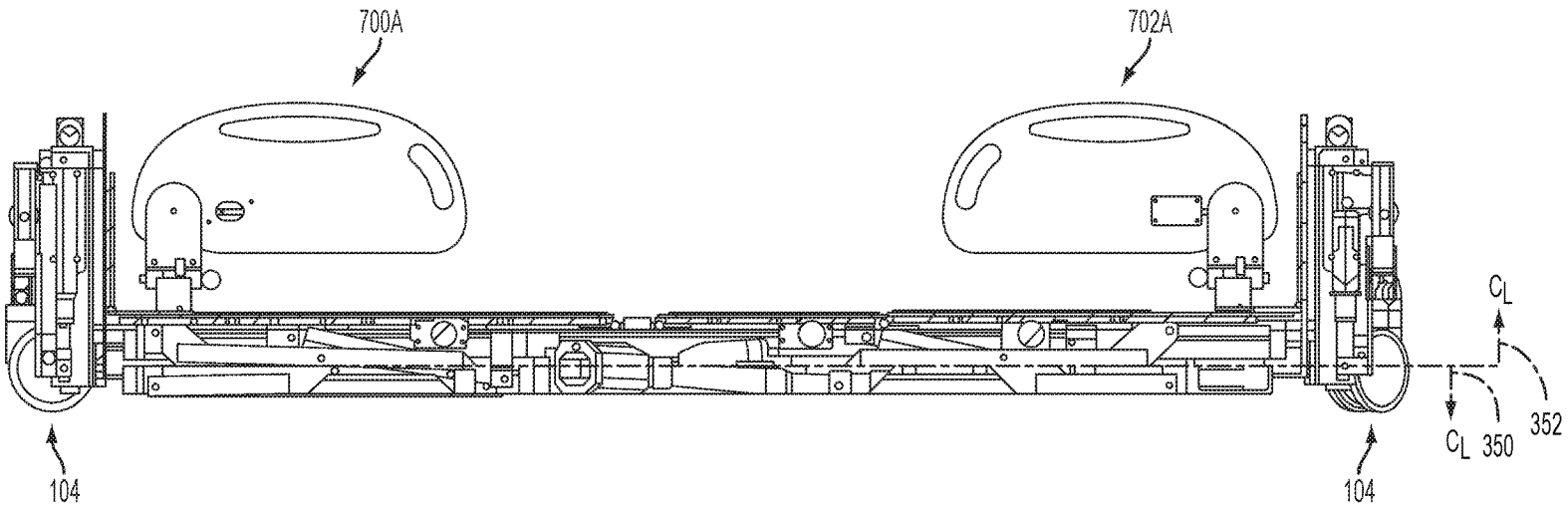
FIG. 17 is a sectional view of the bed along lines 17-17 in FIG. 16.
Figure 18:
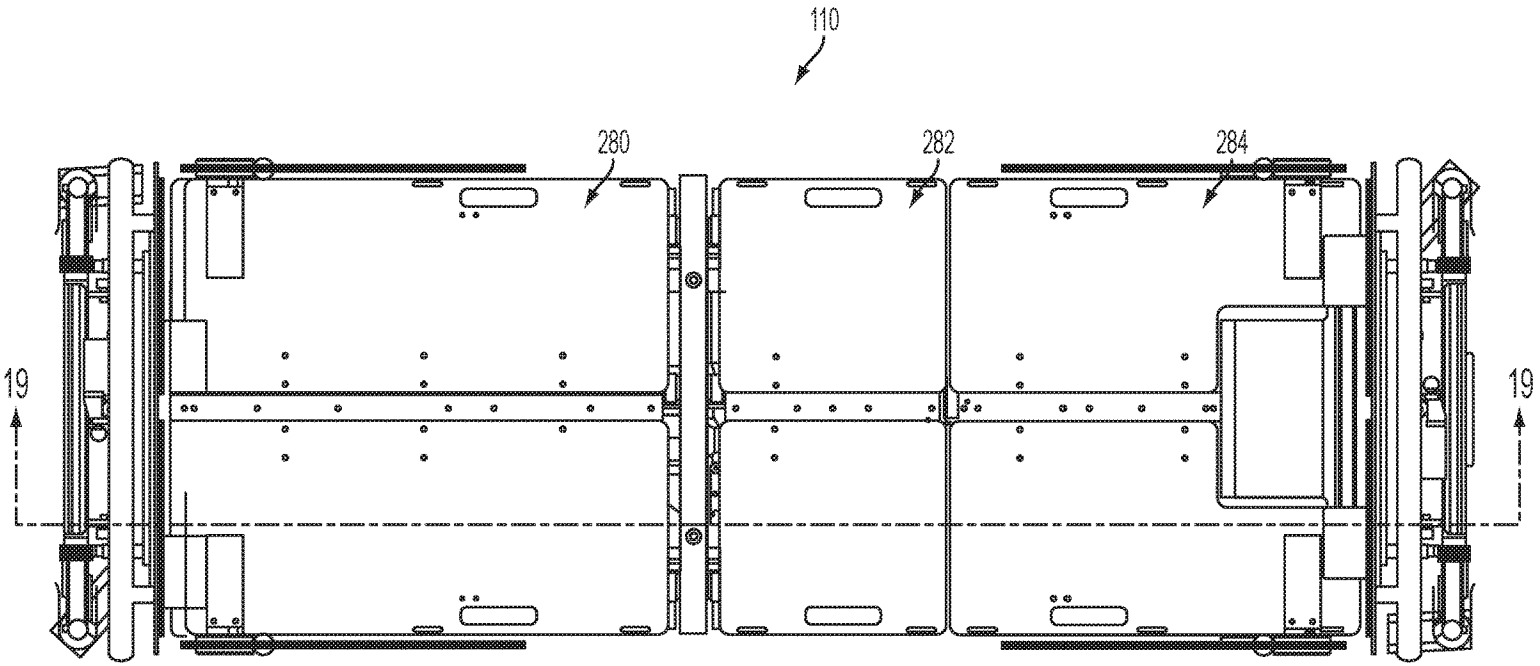
FIG. 18 illustrates a top view of the bed in the configuration of FIG. 1 and with the support deck in a retracted configuration.

Referring to FIG. 17, in the illustrated embodiment, second lift system 160 is sized to nest within open area 220 of first lift system 158. Referring to FIG. 19, when linear actuators 334A, 334B are fully extended a horizontal centerline 350 of middle portion 174 of first lift system 158 is located midway between an upper surface of longitudinally extend member and a lower surface of longitudinally extend member. Second lift system 160 includes a horizontal centerline 352 located midway between an upper surface upper frame 252 and a lower surface of lower frame 250. When support deck 110 is in a first raised position the horizontal centerline 352 of the second lift system 160 is positioned above the horizontal centerline 350 of the first lift system 158. When support deck 110 is in a first lowered position the horizontal centerline 352 of the second lift system 160 is generally aligned with the horizontal centerline 350 of the first lift system 158 as shown in FIG. 17.

Referring to FIG. 7, a barrier component, illustratively an endboard 400A, is shown. A similar endboard is provided with respective to end base 172. Exemplary endboards include headboards (endboard 400A) and footboards (endboard 400B). Additional details regarding the construction and movement of the endboards are provided in provided in U.S. patent application Ser. No. 14/208,987, titled BED SYSTEMS AND METHOD, filed Mar. 13, 2014, the disclosure of which is expressly incorporated by reference herein.

As mentioned herein, the bed frame 102 supports a plurality of barrier components which form a barrier 112 around the support deck 110. Additional details regarding the construction and movement of the plurality of barrier components are provided in provided in U.S. patent application Ser. No. 14/208,987, titled BED SYSTEMS AND METHOD, filed Mar. 13, 2014, the disclosure of which is expressly incorporated by reference herein.

Referring to FIGS. 22-31A, another embodiment 600 for second lift system 160 is provided. Lift system 600 shares many of the same components as second lift system 160. Lift system 600 permits lower frame 250 to move downward in direction 130 relative to floor 106 as second lift system 600 is actuated to expand to increase the mechanical advantage of lifting assemblies 254. In one embodiment, lift system 600 expands by moving the lower frame 250 downward in direction 130 prior to moving upper frame 252 upward in direction 132. Thus, lift system 600 expands initially without imparting an upward movement to support deck 110.

As illustrated in FIG. 13, when second lift system 160 is fully collapsed, the linear actuators 334 and lifting assemblies 254 which move upper frame 252 relative to lower frame 250 are generally horizontal and in line. By permitting lower frame 250 to be lowered relative to upper frame 252 and floor 106, the lifting assemblies 254 become more angled relative to horizontal and thereby providing the linear actuators 334 an increased mechanical advantage.

Figure 25:
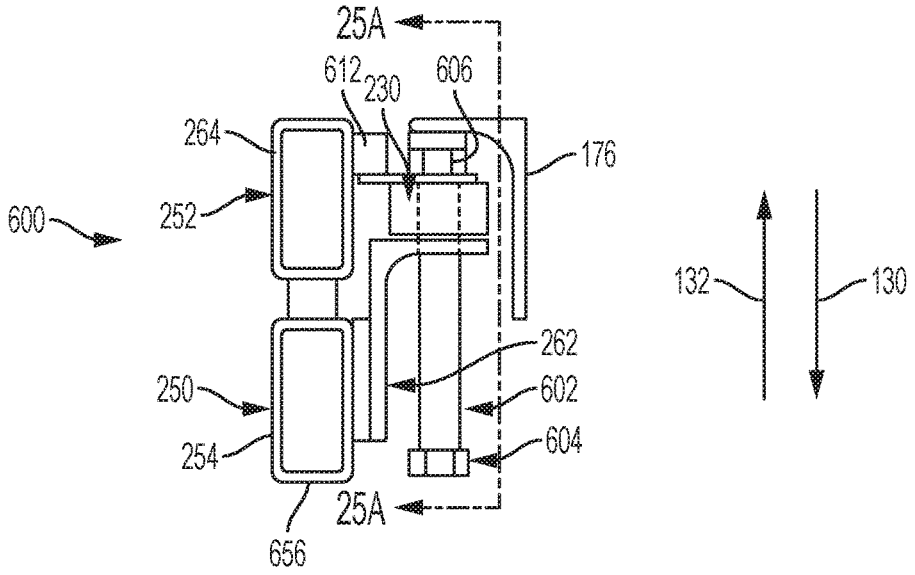
FIG. 25 is a sectional view of portions of another embodiment of the first lift system and the second lift system corresponding to lines 25-25 in FIG. 22.
Figure 25A:
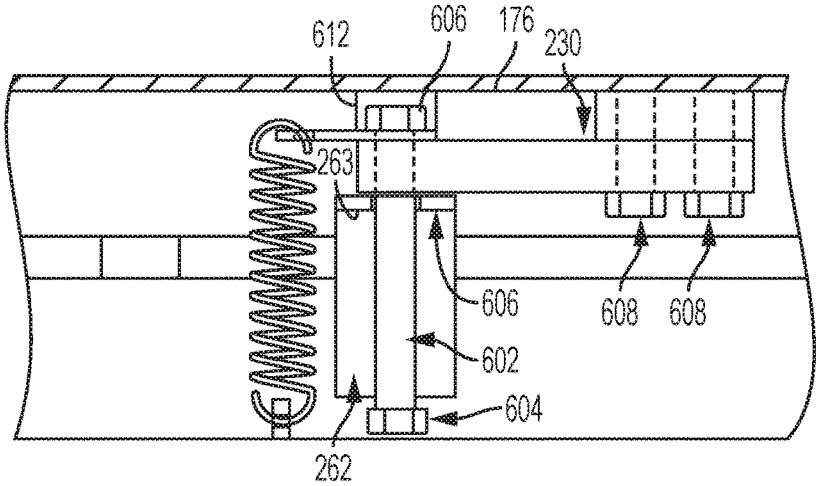
FIG. 25A is a view of portions of the first lift system and the second lift system along direction A in FIG. 25.

Referring to FIG. 25, lift system 600 includes an elongated member 602 with a stop member 604. The illustrated elongated member 602 and stop member 604 are portions of a hex bolt. As shown in FIG. 25A, brackets 262 includes an opening 606 which receives elongated member 602 and permits brackets 262 to move in directions 130, 132. Elongated member 602 is secured to load cells 230 with a fastener 606, illustratively a nut. As shown in FIGS. 25 and 25A, load cell 230 is secured to frame member 176 through bolts 608. Second lift system 160 is supported by first lift system 158 through load cells 230.

Figure 28:
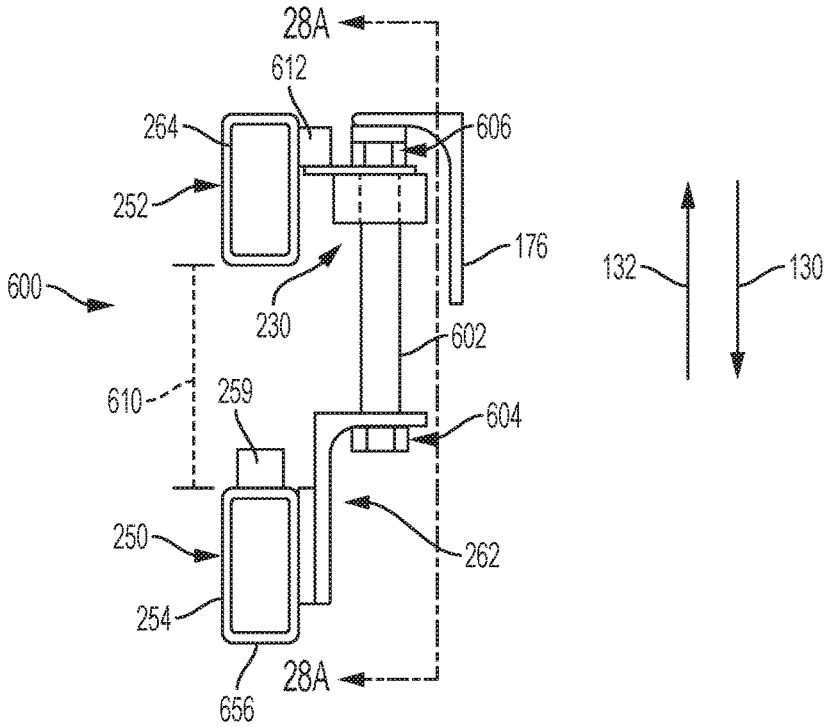
FIG. 28 is a sectional view of portions of the first lift system and the second lift system of FIG. 26 along lines 28-28 in FIG. 26.
Figure 28A:
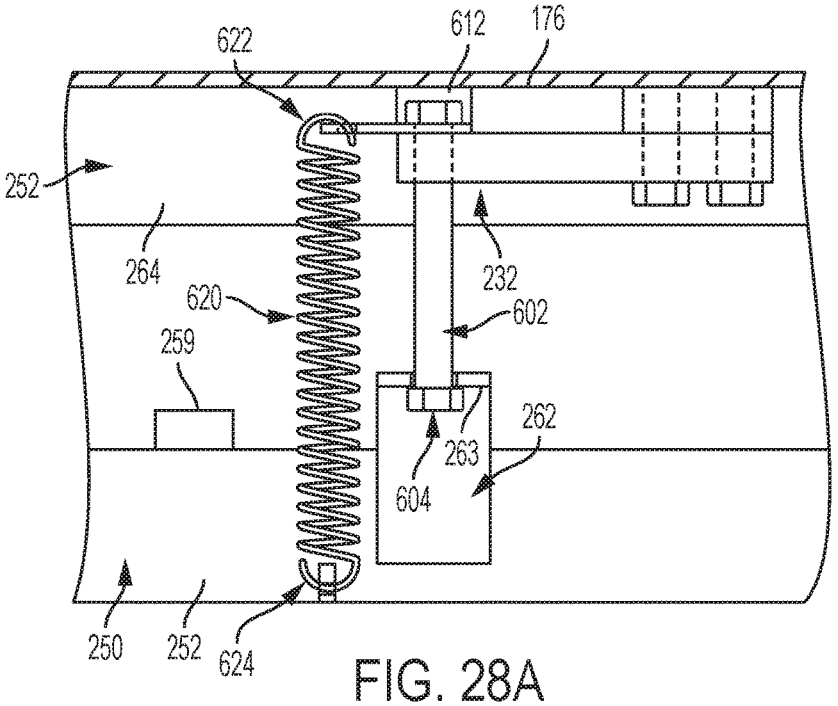
FIG. 28A is a view of portions of the first lift system and the second lift system along direction A in FIG. 28.

Referring to FIGS. 28 and 28A, elongated member 602 permits lower frame 250 to move downward in direction 130 which increases a separation 610 between frame member 254 and frame member 264. In the illustrated embodiment, as lower frame 250 moves downward in direction 130, upper frame 252 remains at its same position as illustrated in FIGS. 25 and 25A. Frame member 254 may continue to move in direction 130 until brackets 262 contacts stop member 604. Frame member 254 is moved downward due to the actuation of linear actuators 334 and lifting assemblies 254.

When brackets 262 contacts stop member 604, frame member 254 is locked relative to first lift system 158 and any further actuation of the linear actuators 334 and lifting assemblies 254 result in upper frame 252 being raised in direction 132. In one embodiment, separation 610 is a first distance, such as about 0.5 inches, when stop member 259 contacts frame member 264 and is a second distance, such as 3.0 inches when frame member 254 is moved downward in direction 130 until brackets 262 contacts stop member 604. This movement of frame member 254 in direction 130 allows lower frame 250 and upper frame 252 of second lift system 160 to separate about 3.0 inches allowing the frame member 254 to open and give the actuators 334 a mechanical advantage to increase the overall lift second lift system 160 from about 900 lbs. to about 1350 lbs.

As the lower frame 250 moves in direction 130, upper frame 252 is kept from rising due to the weight/load on the upper lift frame 252. Exemplary loads include the support deck 110, a patient support supported by support deck 110, and a patient supported by support deck 110. Further, support members 612 coupled to frame member 264 contact load cells 230. Thus, load cells 230 supports the weight/load on upper lift frame 252 as lower frame 250 is moved downward.

Figure 31:
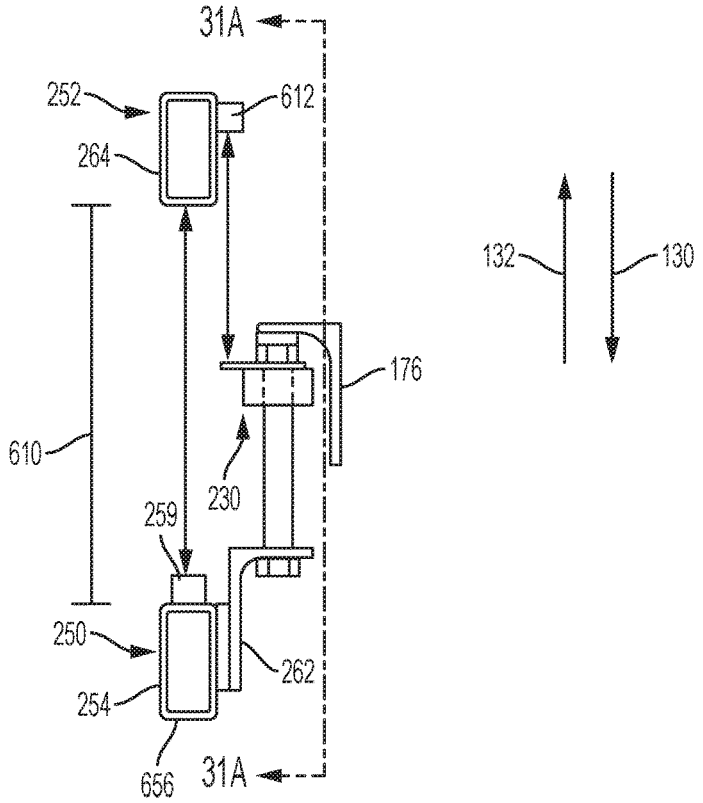
FIG. 31 is a sectional view of portions of the first lift system and the second lift system of FIG. 29 along lines 31-31 in FIG. 29.
Figure 31A:
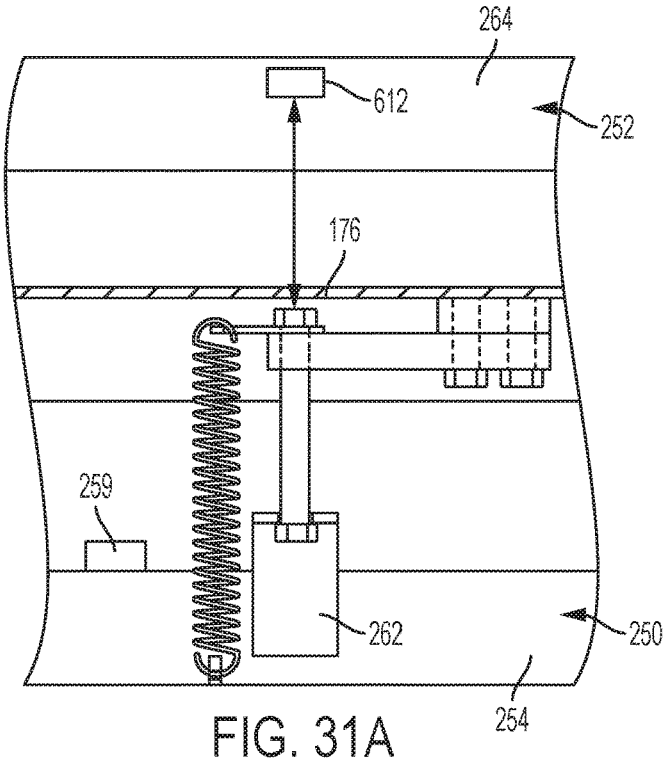
FIG. 31A is a view of portions of the first lift system and the second lift system along direction A in FIG. 31.

Once brackets 262 contacts stop member 604, further downward movement of frame member 254 of lower frame 250 in direction 130 is stopped and further actuation of linear actuators 334 and frame member 254 results in upper frame 252 moving upward in direction 132. Referring to FIGS. 31 and 31A, the further actuation of linear actuators 334 and frame member 254 is illustrated. As shown in FIG. 31, frame member 264 and support members 612 are spaced apart from load cells 230 in direction 132. Further, separation 610 has increased to a third distance, larger than the second distance while frame member 254 remains in the same location as shown in FIG. 28.

As illustrated in FIGS. 25A, 28A, and 31A, in one embodiment, a tension spring 620 is provided. Tension spring 620 is coupled at a first end 622 to load cells 230 and at a second end 624 to frame member 254. Tension spring 620 is provided to offset the weight of the lower lift frame 250 and to assist the linear actuators 334 during retraction to bring lower frame 250 and upper frame 252 together.

Figure 22:
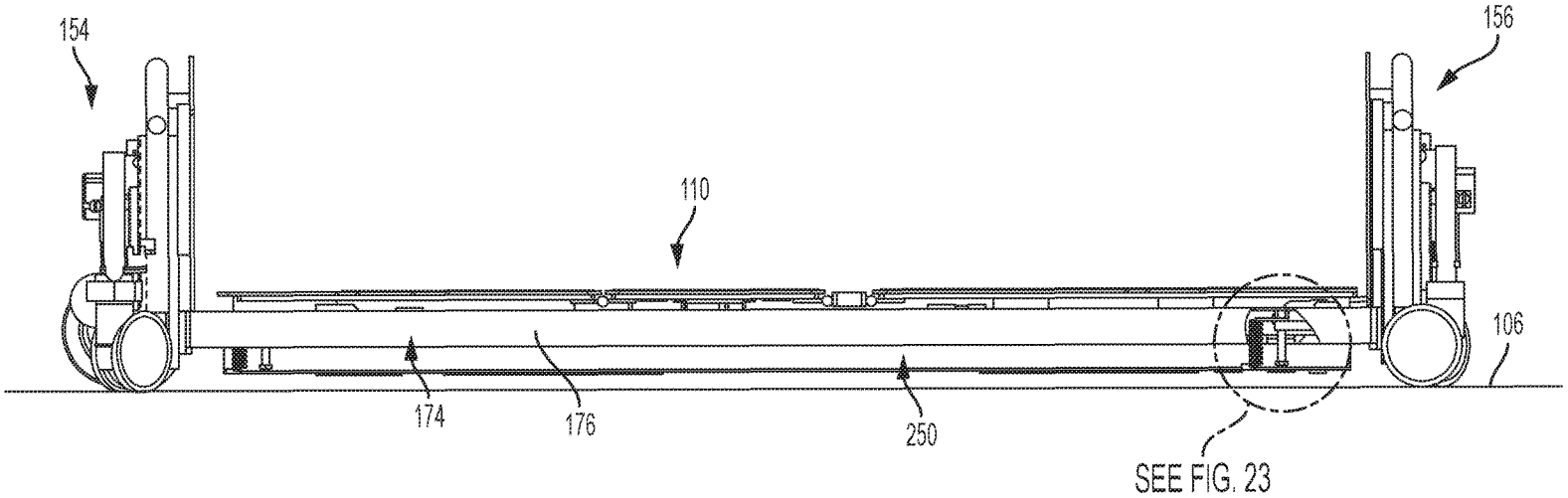
FIG. 22 is a side view of the bed of FIG. 1 with the first lift system in a lowered position and including another embodiment of the second lift system with a partial cutaway section.
Figure 23:
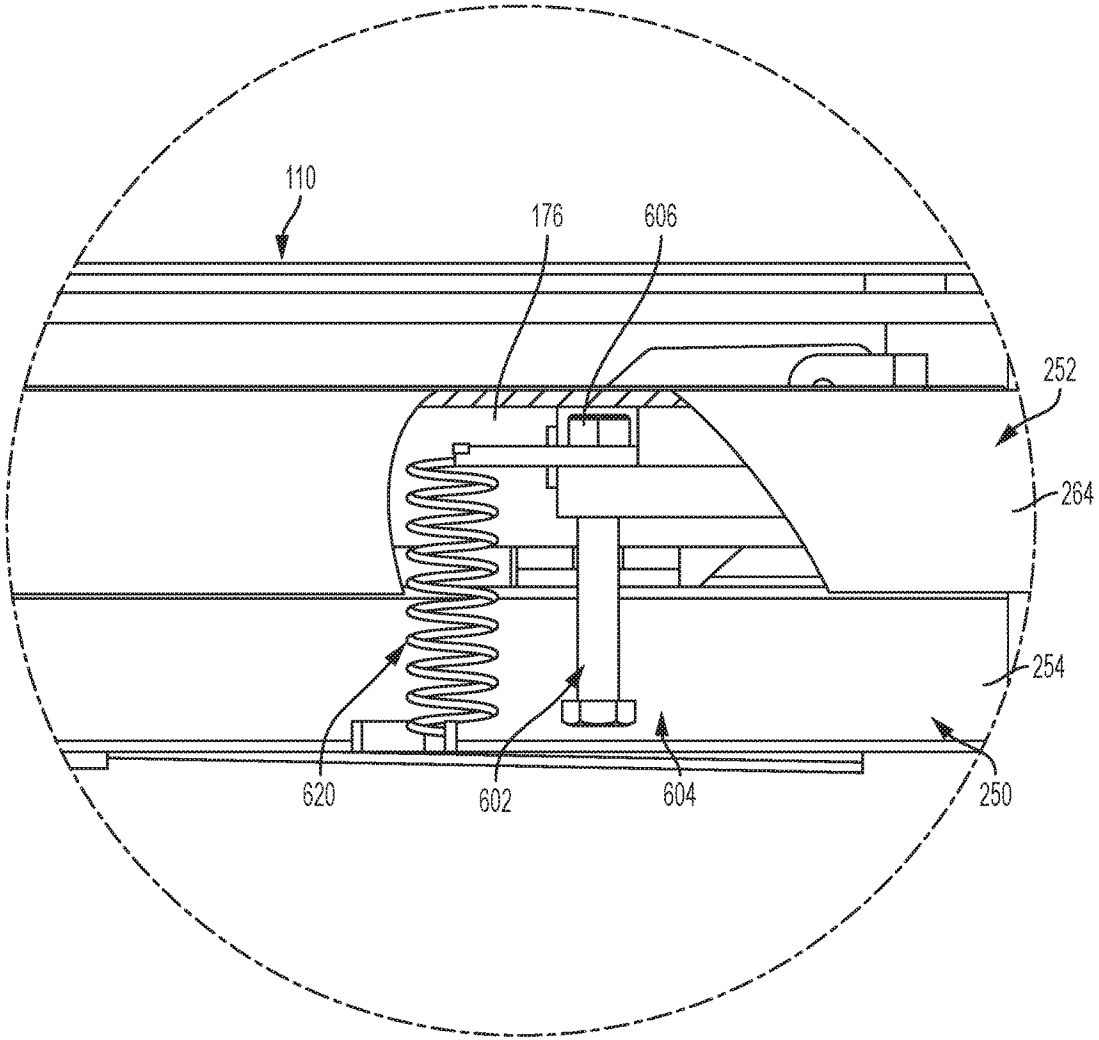
FIG. 23 is a detail view of the cutaway section of FIG. 22.

FIGS. 22-24, 26, 27, 29, and 30 further illustrate the operation of lift system 600 within bed 100. Referring to FIGS. 22 and 23, bed 100 is lowered all the way to the lowest position relative to floor 106. In FIGS. 22 and 23, both first lift system 158 and lift system 600 are fully collapsed. As shown in FIG. 23, lower frame 250 and upper frame 252 are drawn together so that the total height of lower frame 250 and upper frame 252 combined is less than about 6 inches which allows an upper surface of support deck 110 and the patient support positioned thereon to be at its lowest point of about 7 inches.

Figure 24:
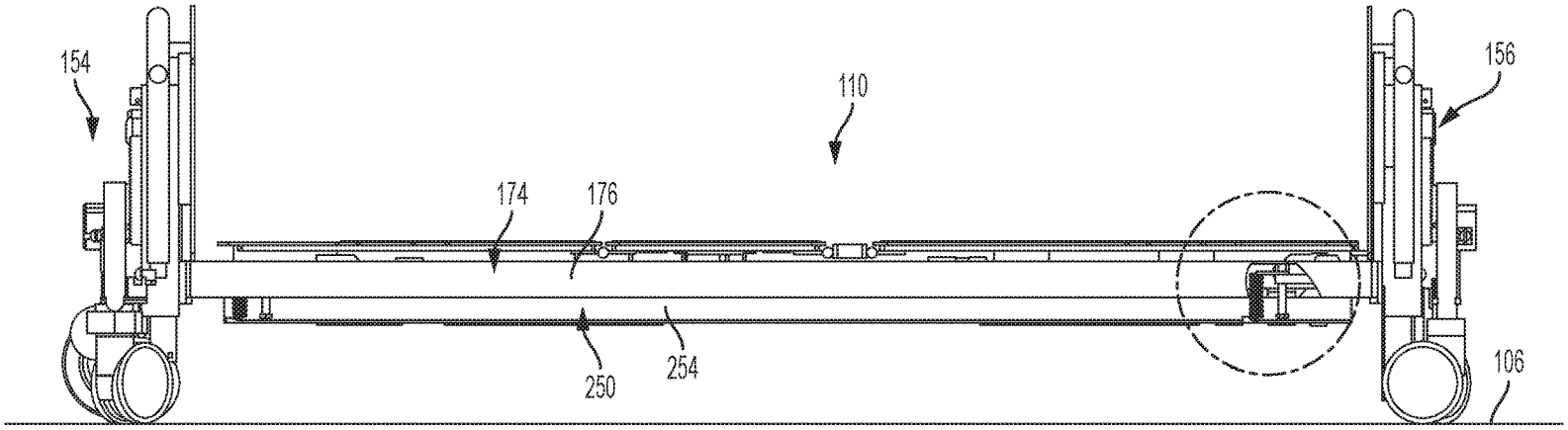
FIG. 24 illustrates the arrangement of FIG. 22 with the first lift system in a raised position.

Referring to FIG. 24, first lift system 158 has been raised relative to FIG. 22 which results in lift system 600 and support deck 110 also being raised. In one embodiment, the upper surface of support deck 110 which the patient support positioned thereon is about 15 inches above the floor 106. Lower frame 250 and upper frame 252 of lift system 600 are still drawn together in the arrangement shown in FIG. 24.

Figure 26:
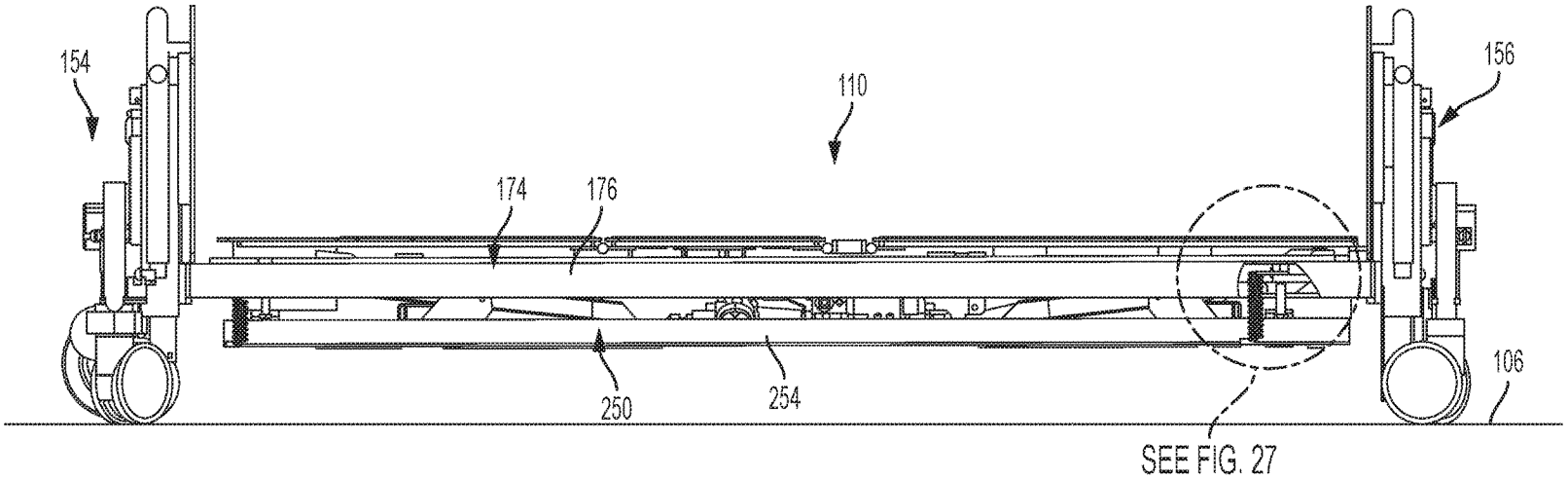
FIG. 26 illustrates the arrangement of FIG. 24 with a lower portion of the second lift frame lowered.
Figure 27:
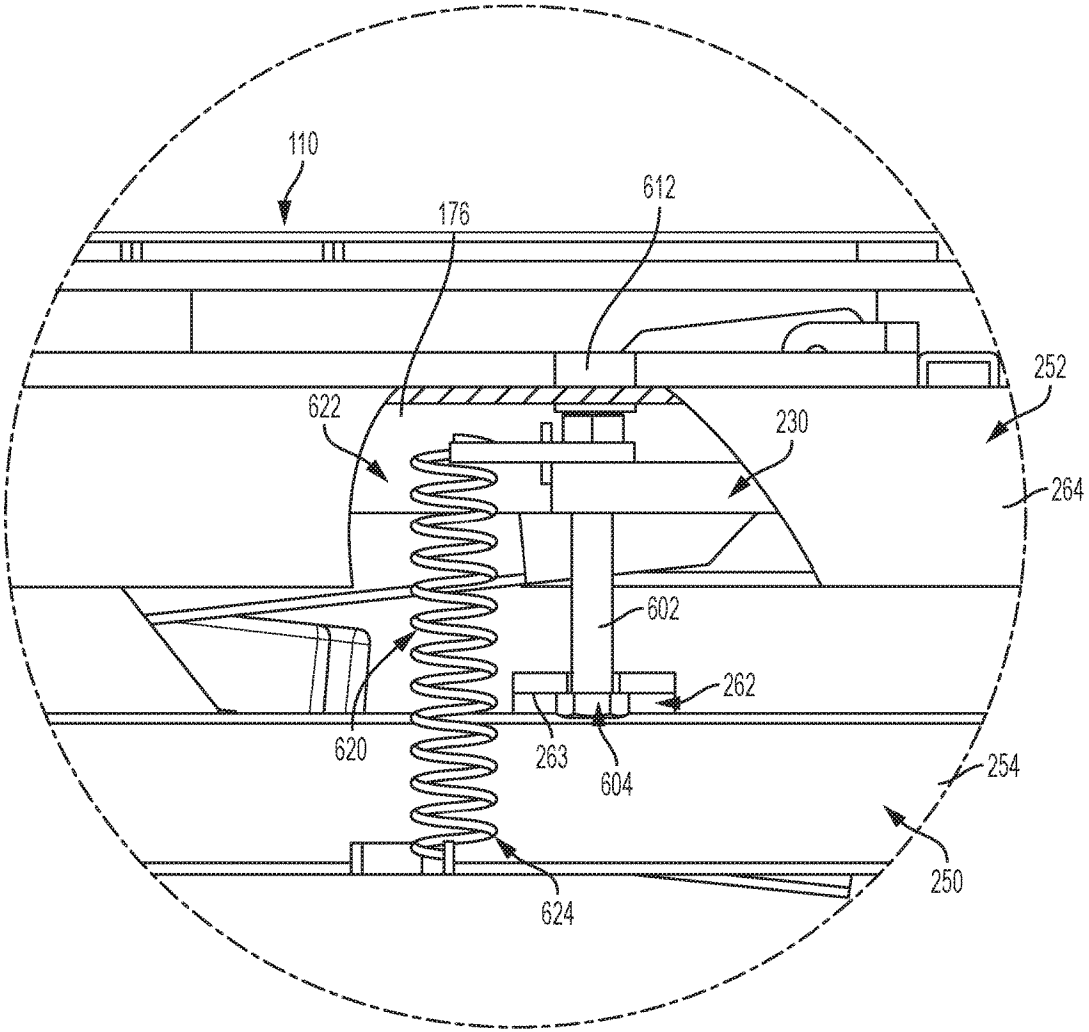
FIG. 27 is a detail view of the cutaway section of FIG. 26.

With bed 100 in the arrangement shown in FIG. 24, lift system 600 may be expanded to further lift support deck 110 relative to the floor 106. The added clearance from floor 106 permits lower frame 250 to be lowered towards floor 106 in direction 130. Referring to FIGS. 26 and 27, lower frame 250 is shown lowered relative to upper frame 252. As shown in FIG. 26, a height of support deck 110 relative to floor 106 remains unchanged from FIG. 24. As shown in FIG. 27, illustrates a lower surface 263 of brackets 262 contacting stop member 604 of elongated member 602 due to the movement of lower frame 250 in direction 130.

Figure 29:
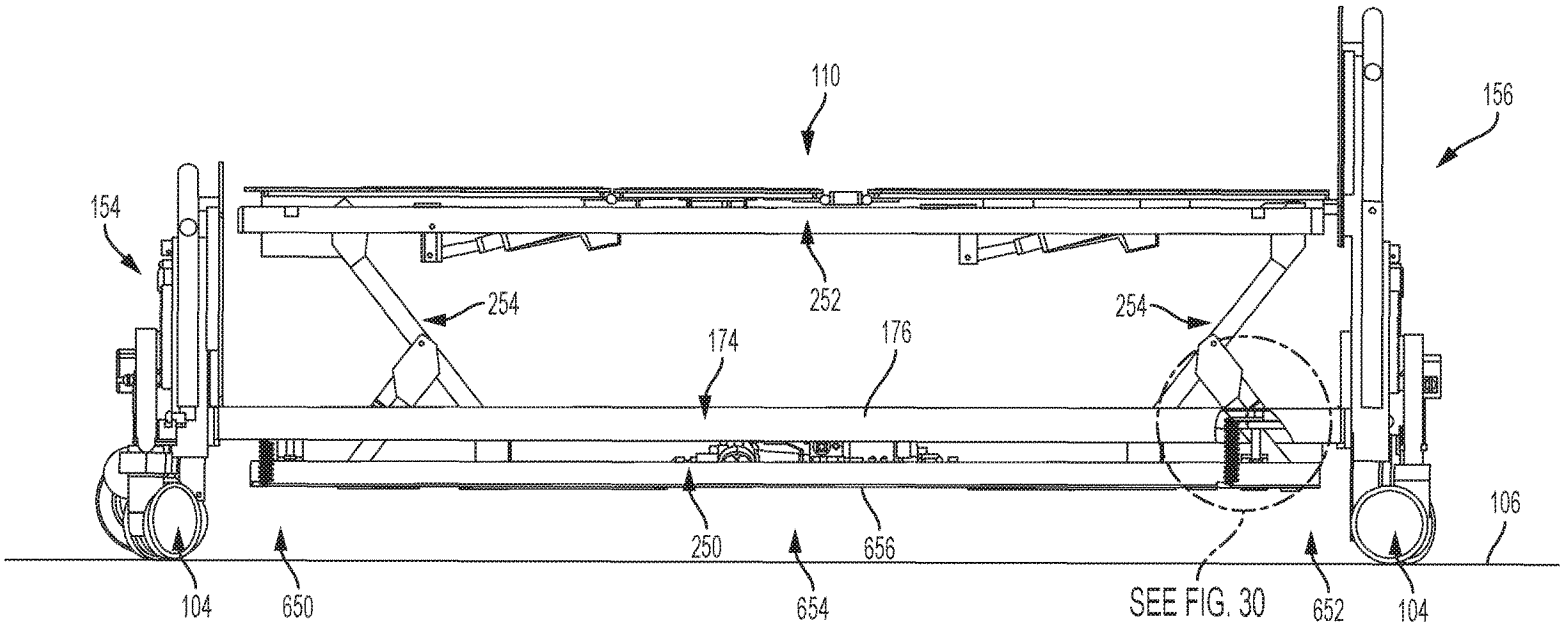
FIG. 29 illustrates the arrangement of FIG. 26 with an upper portion of the second lift frame raised.
Figure 30:
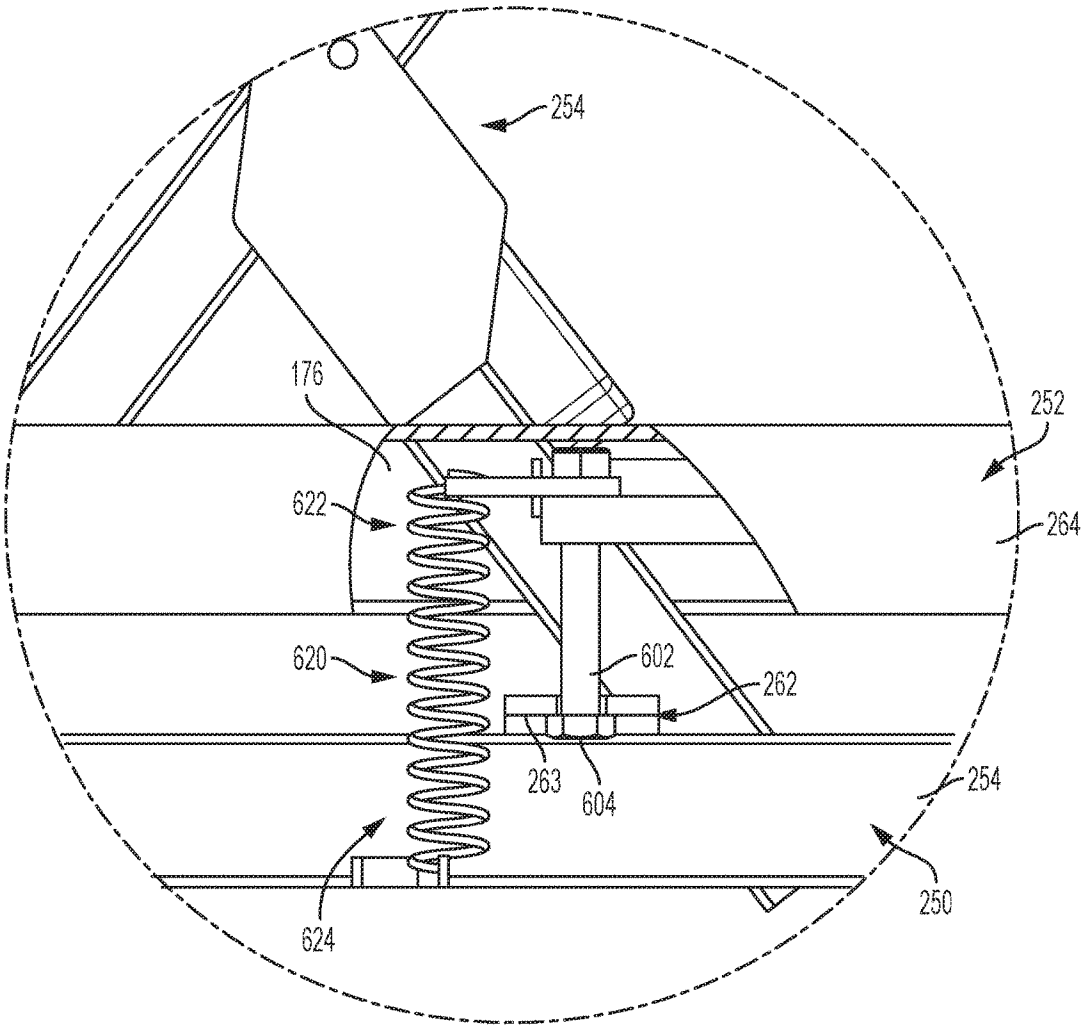
FIG. 30 is a detail view of the cutaway section of FIG. 29.

Referring to FIGS. 29 and 30, support deck 110 is shown raised to an upper height of about 34 inches above the floor 106. As shown in FIG. 30, lower frame 250 has the same arrangement relative to frame member 176 as shown in FIG. 27. This is due to lower surface 263 of brackets 262 contacting stop member 604 of 602 which prevents the further movement of lower frame 250 in direction 130. As such, a further actuation of linear actuators 334 results in upper frame 252 and support deck 110 being raised upward relative to first lift system 158.

In one embodiment, when bed 100 is moved from the lowered position shown in FIG. 22 to the raised position shown in FIG. 29, both lower frame 250 and upper frame 252 of lift system 600 are raised in direction 132, followed by lower frame 250 of lift system 600 being lowered in direction 130, and followed by upper frame 252 of lift system 600 being raised in direction 132. When bed 100 is lowered, from the raised position shown in FIG. 29 to the lowered position in FIG. 22, upper frame 252 of lift system 600 moves downward in direction 130, followed by an upward movement of lower frame 250 of lift system 600 in direction 132, and followed by lower frame 250 and upper frame 252 of lift system 600 being lowered in direction 130.

In the illustrated embodiment, bed 100 includes a lift system 600 supported by the plurality of wheels 104. Lift system 600 is operatively coupled to the support deck 110 to raise and lower the support deck 110 relative to the plurality of wheels 104. Referring to FIG. 29, lift system 600 includes a head end portion 650 positioned proximate the headboard 400A, a foot end portion 652 positioned proximate the footboard 400B, and a middle portion 654 positioned between the head end portion 650 and the foot end portion 652. The middle portion 654 includes a bottom side 656 facing the floor 106. As lift system 600 raises support deck 110 from a lowered position (for example see FIG. 22 or FIG. 24) to a raised position (for example see FIG. 29), the bottom side 656 of the middle portion 654 moves downward in direction 130 (see FIG. 28). The bottom side 656 of the middle portion 654 remains the bottom side 654 of the middle portion 654 throughout the movement of the support deck 110 from the lowered position to the raised position.

Figure 32:
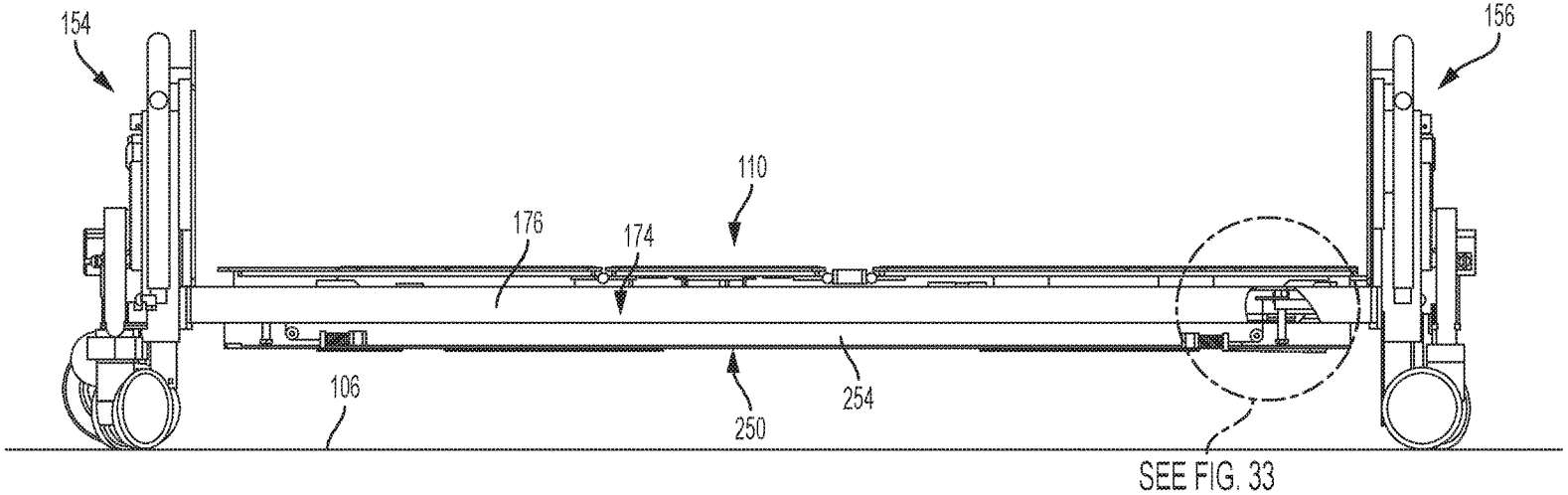
FIG. 32 is a side view of the bed of FIG. 1 with the first lift system in a raised position and including still another embodiment of the second lift system with a partial cutaway section.
Figure 33:
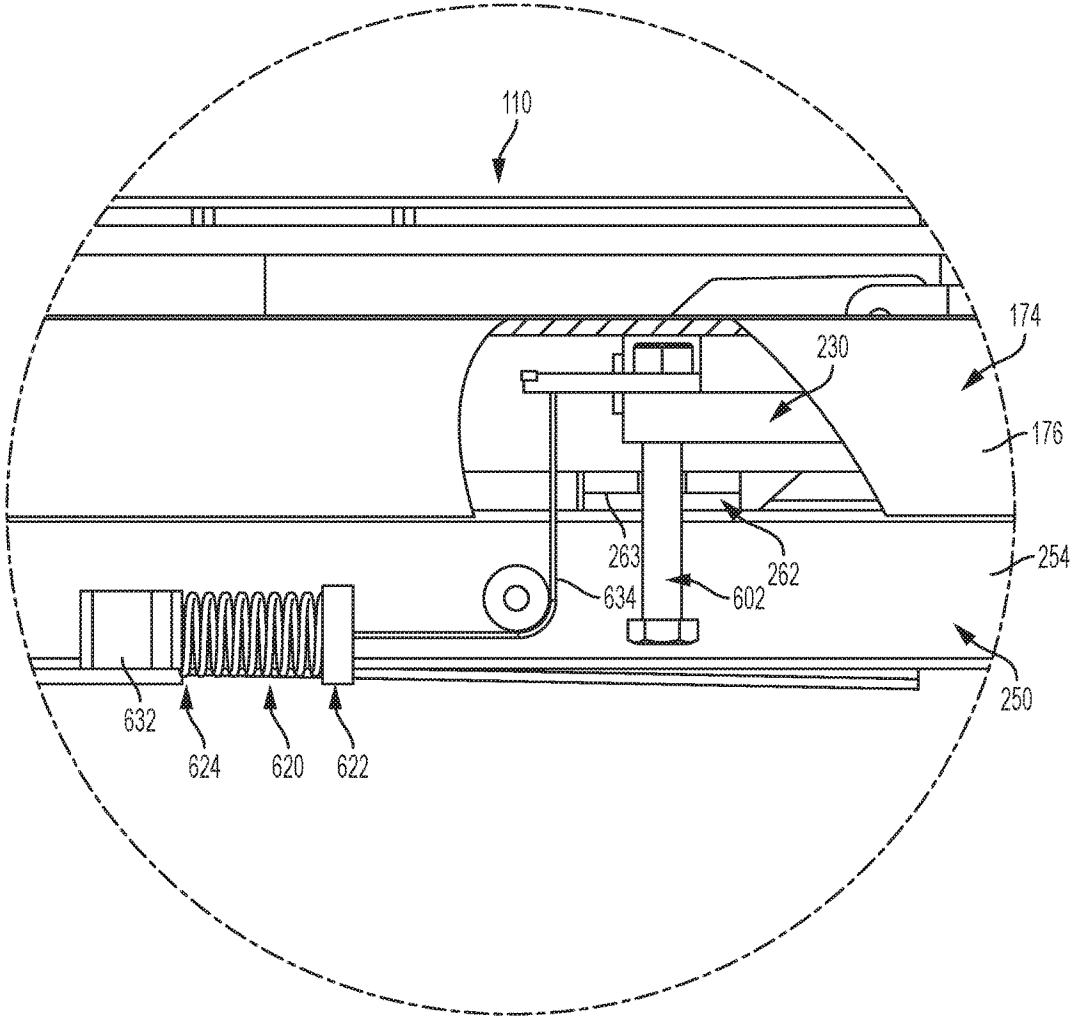
FIG. 33 is a detail view of the cutaway section of FIG. 32.

Referring to FIGS. 32 and 33 an alternative arrangement for tension spring 620 is shown. As shown in FIG. 33, tension spring 620 is coupled on a first end 622 to a moveable support block 630 and on a second end 624 to a fixed support block 632. Moveable support block 630 is coupled to load cells 230 through a cable 634 which passes over a roller 640. As shown in FIG. 33, tension spring 620 is in a compressed state when lower frame 250 and upper frame 252 of lift system 600 are collapsed. Moveable support block 630 travels in direction 642 resulting in spring 620 being stretched in direction 642, as lower frame 250 of lift system 600 is lowered relative to upper frame 252 of lift system 600. Moveable support block 630 travels in direction 644 resulting in spring 620 being returned to its compressed state, as lower frame 250 of lift system 600 is raised relative to upper frame 252 of lift system 600. Although a tension spring 620 is illustrated, other tensioning members may be used. Exemplary tensioning members include a gas tubular spring.

Figure 34:
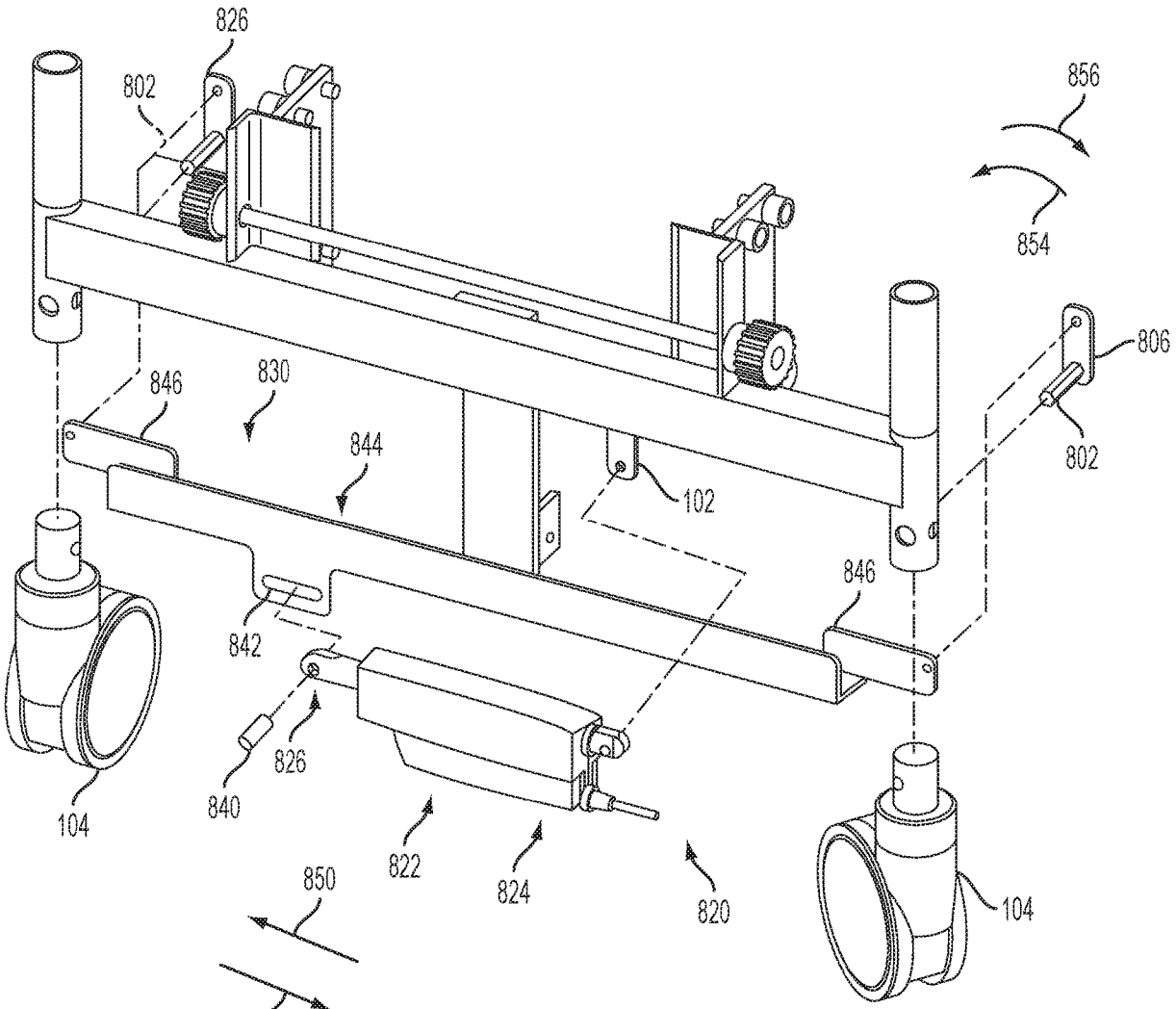
FIGS. 34 and 35 illustrate exemplary components of a non-powered caster brake system and a powered caster brake system.
Figure 35:
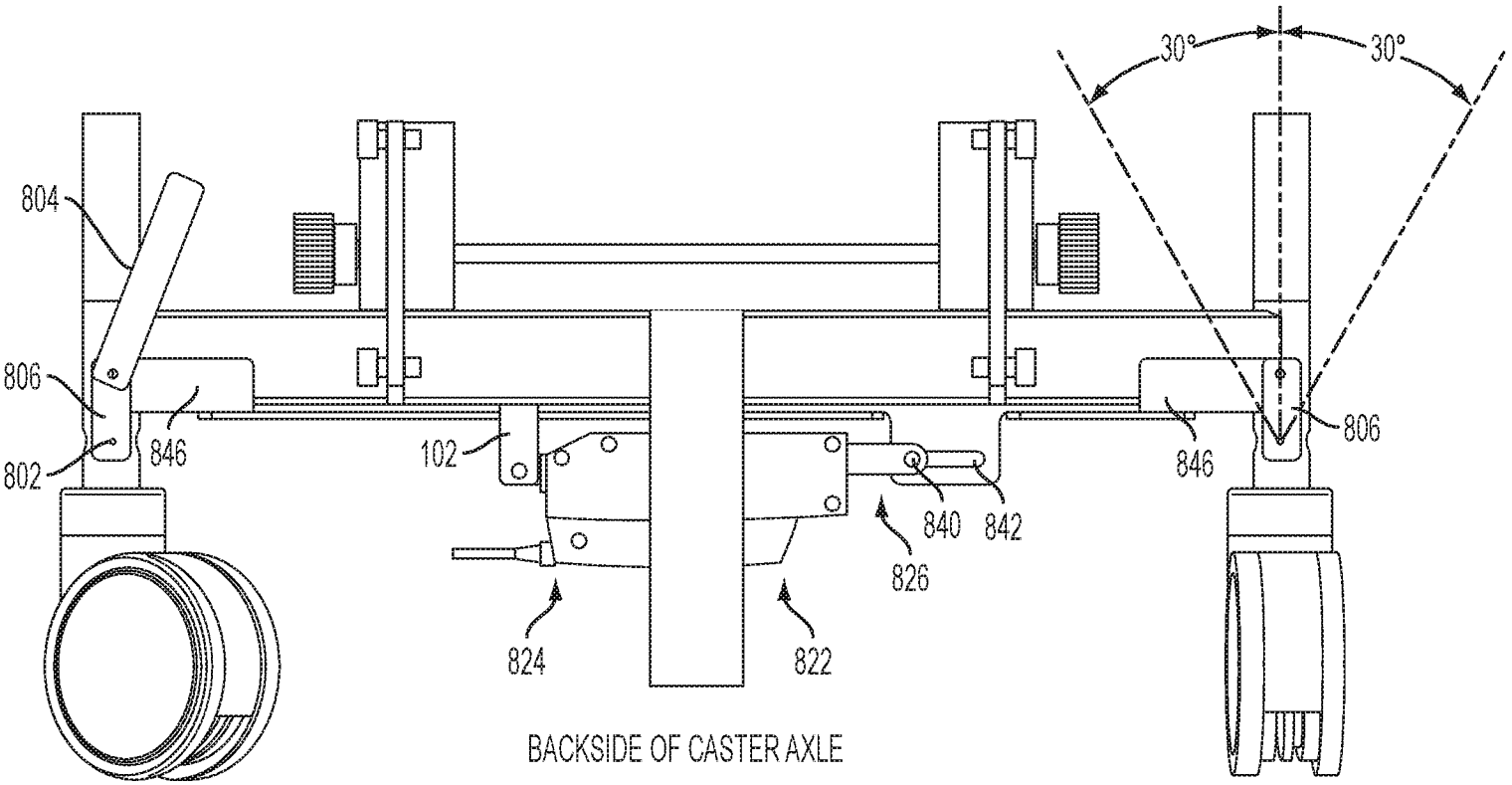

Referring to FIGS. 34 and 35, an exemplary caster braking system 800 is shown. In one embodiment, wheels 104 are 6" Swivel/Total Lock Directional Lock casters available from TENTE CASTERS Inc. located at 2266 Southpark Drive in Hebron, Ky. 41048. A hex shaft 802 is received in the caster assembly and may be rotated to place the caster assembly in one of three modes. A first mode is a locked position also referred to as brake which prevents bed 100 from moving and/or being moved relative to floor 106. A second mode is the caster mode in which the caster is set to allow bed 100 to be freely rolled and/or move from one place to another relative to floor 106. A third mode is steer mode when the caster is set to roll in a fixed direction. The caster includes an internal mechanism which is actuated by rotation of hex shaft 802 a fixed number of degrees in either direction. As shown in FIG. 35, a lever 804 is coupled to hex shaft 802 through an extension 806 to rotate hex shaft 802. Lever 804 may be grasped by an operator and pulled or pushed to rotate hex shaft 802. This is an example of a non-powered caster wheel control system.

A powered caster wheel control system 820 is also provided to actuate hex shaft 802. Referring to FIG. 34, powered caster wheel control system 820 includes a linear actuator 822 which is operatively coupled to bed frame 102 on a first end 824 and operatively coupled to a mechanical linkage assembly 830 on a second end 826. As is known, linear actuator 822 can alter a separation between first end 824 and second end 826 to lengthen or shorten the separation.

In the illustrated embodiment, second end 826 is coupled to a pin 840 which is received in an elongated slot 842 of a transversely extending member 844. Member 844 is coupled to a plurality of wings 846. Each wing is pivotally coupled to respective extensions 806. When linear actuator 822 drives member 844 in direction 850, both of the extensions 806 are rotated in direction 854 which in turn rotates hex shaft 802 in direction 854. When linear actuator 822 drives member 844 in direction 852, both of the extensions 806 are rotated in direction 856 which in turn rotates hex shaft 802 in direction 856.

As shown in FIG. 35, pin 840 is received in elongated slot 842. Assuming pin 840 is centered in elongated slot 842 before linear actuator 822 is actuated to cause a rotation of hex shaft 802, pin 840 is first be moved to an end of elongated slot 842 before member 844 begins to move. In one embodiment, after linear actuator 822 has effected the desired movement of hex shaft 802, linear actuator 822 reverses direction and centers pin 840 in elongated slot 842. By having pin 840 centered in elongated slot 842, an operator may grasp lever 804 and change the mode of wheels 104 independent of powered caster wheel control system 820.

Figure 36:
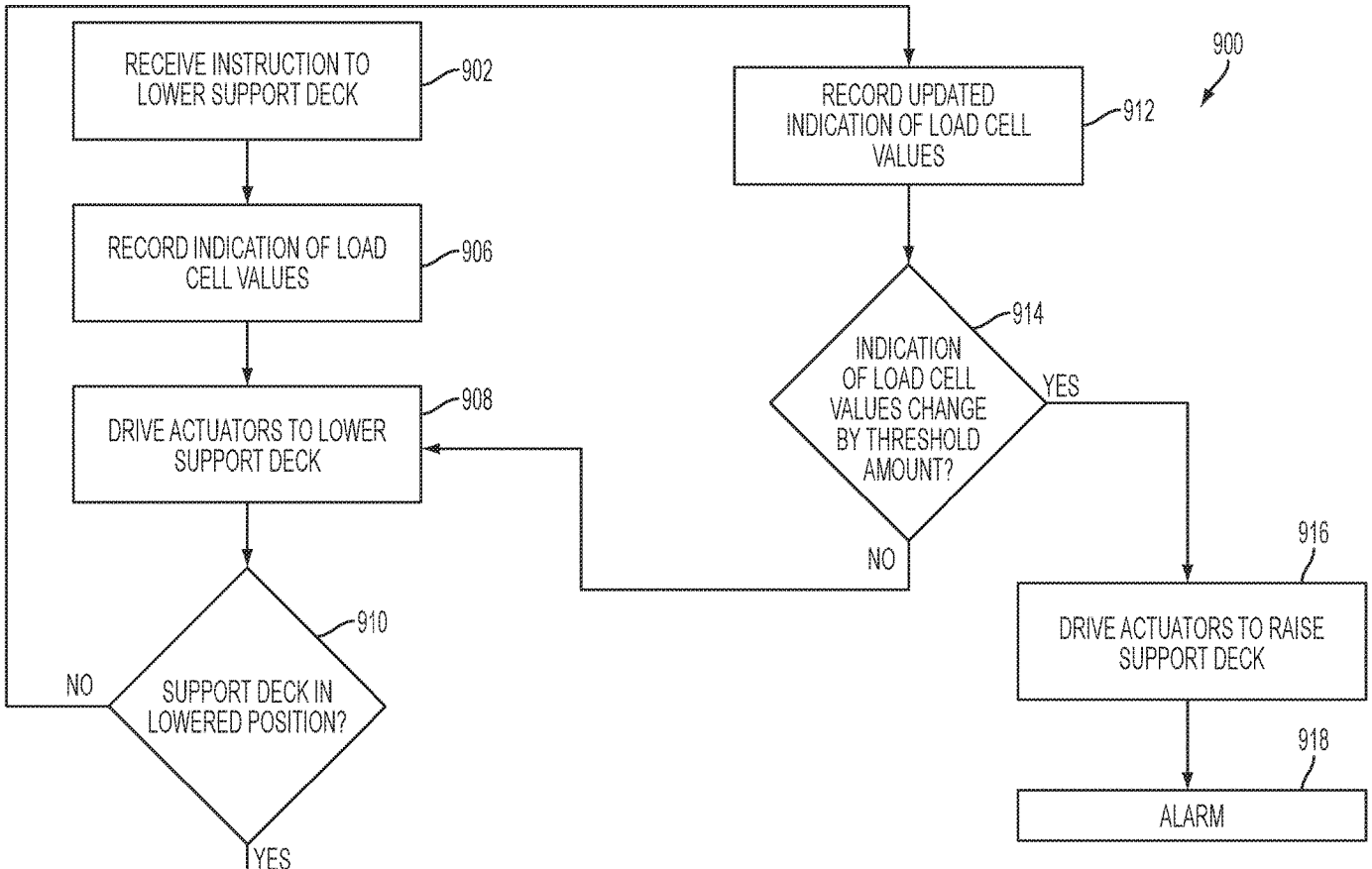
FIG. 36 illustrates an exemplary obstacle detection method.

Referring to FIG. 36, an exemplary obstacle detection method 900 is shown. In one embodiment, method 900 is implemented as logic executed by controller 550. The obstacle detection method 900 is used to determine if an obstacle is present under lift system 120 as support deck 110 is being moved to the lowered position of FIG. 2.

An instruction to lower the support deck is received by controller 550, as represented by block 902. In one embodiment, bed 100 includes a control interface that includes an input which when actuated provides an indication to controller 550 to lower support deck 110. Controller 550 records an indication of the load cell 230 values, as represented by block 906. In one embodiment, the indication is a determined weight. In one embodiment, the indication is the individual outputs of the load cells 230. Controller 550 then provides an input to the respective actuators to lower support deck 110, as represented by block 908.

Controller 550 determines if support deck 110 is in the lowered position, as represented by block 910. If not, controller 550 records an updated indication of the load cell values, as represented by block 912. Powered system 500 compares the updated indication of the load cell values to the prior indication of the load cell values and determines if the difference exceeds a threshold value, as represented by block 914. If the threshold value is not exceeded, controller 550 continues to lower support deck 110 as represented by block 908. If the threshold is exceeded, controller 550 halts the lowering of support deck 110 and instructs the actuators to raise support deck 110, as represented by block 916. Further, controller 550 initiates an alarm, as represented by block 918. Exemplary alarms include visual alarms, audio alarms, and tactile alarms.

In one embodiment, when an obstacle is present under bed 100, one of first lift system 158 and second lift system 160 will contact the obstacle as support deck 110 is being lowered. This results in the obstacle supporting part of the weight of support deck 110. This changes the weight being supported by load cells 230 or at least redistributes the weight between the load cells 230.

Referring to FIG. 3, in one embodiment, bed 100 includes a powered drive system 700 including a drive unit 702 and a drive control unit 704. In the illustrated embodiment, drive unit 702 is positioned at a first end of bed 100, illustratively foot end 152, and drive control unit 704 is positioned at a second end of bed 100, illustratively head end 150. In one embodiment, drive unit 702 is positioned at head end 150 and drive control unit 704 is positioned at foot end 152. In one embodiment, drive unit 702 and drive control unit 704 are positioned at the same end, either head end 150 or foot end 152. In one embodiment, drive unit 702 is positioned between head end 150 and foot end 152 and drive control unit 704 is positioned at one of head end 150 and foot end 152.

Figure 37:
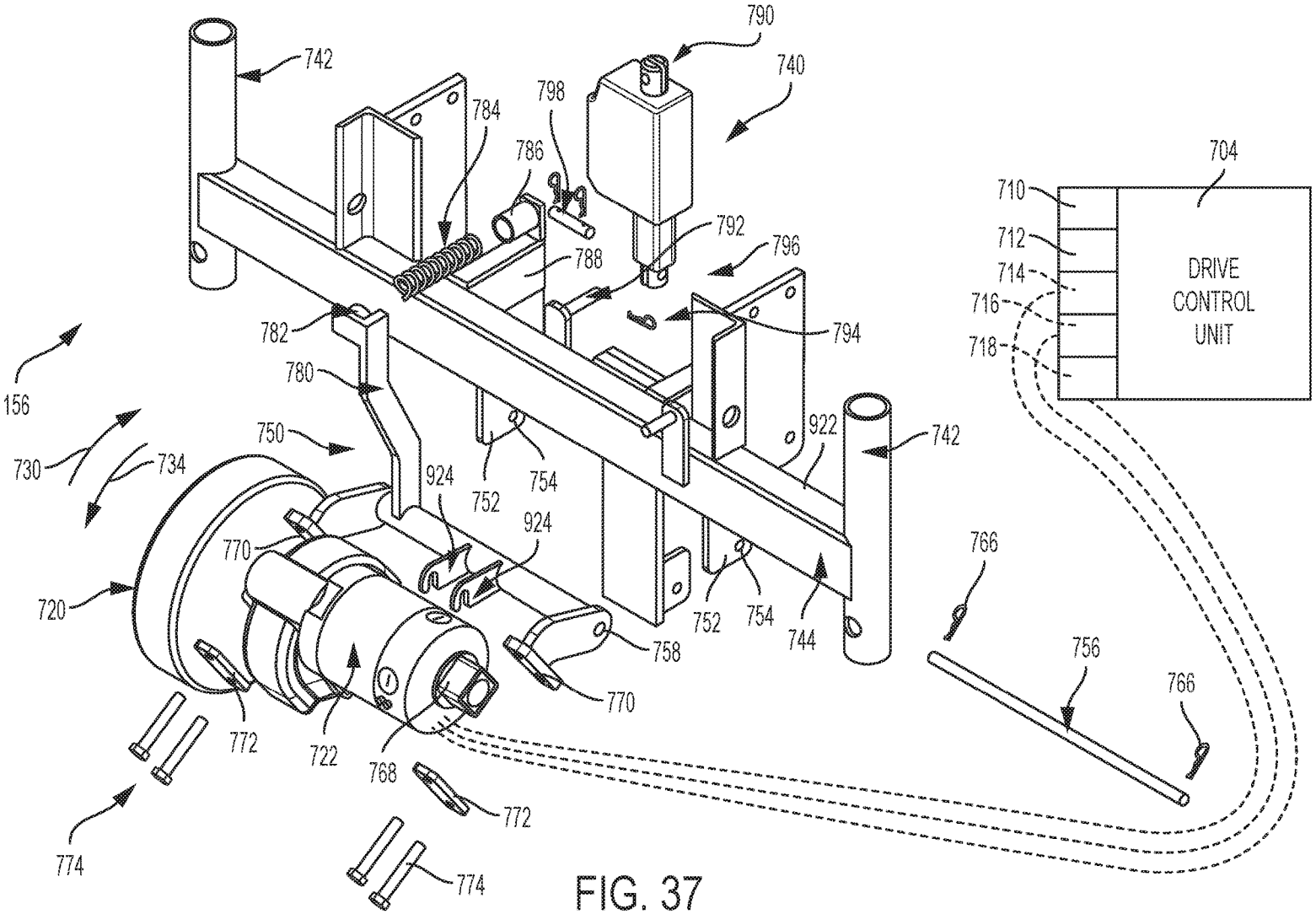
FIG. 37 illustrates an exploded view of an exemplary drive system for the bed of FIG. 1.

Referring to FIGS. 37-45, an exemplary embodiment of drive unit 702 is shown. Referring to FIG. 37, a drive wheel 720 is shown. The drive unit 702 includes multiple drive wheels 720 (see FIG. 38), but only one drive wheel 720 is illustrated in FIG. 37. Drive wheel 720 is coupled to and driven by an electric motor. In the illustrated embodiment, drive wheel 720 is coupled to and driven by an electric motorized differential transaxle 722. An exemplary electric motorized differential transaxle 722 is manufactured by ASI Technologies Inc. located at 209 Progress Drive in Montgomeryville, Pa. 18936.

Drive control unit 704 controls motorized differential transaxle 722 through a first user input 714 and a second user input 716. Exemplary user inputs include buttons, switches, levers, touch screen, joysticks, and other devices capable of receiving an operator input. In one embodiment, first user input 714 controls motorized differential transaxle 722 to rotate drive wheel 720 in a first direction 730 causing bed 100 to move in a forward direction 732 and at a specified speed (see FIG. 42) and second user input 716 controls motorized differential transaxle 722 to rotate drive wheel 720 in a second direction 734 causing bed 100 to move in a reverse direction 736 and at a specified speed (see FIG. 42). In one embodiment, drive control unit 704 includes a Model No. SPR-2400R controller manufactured by Yi-Yun Company located in China (www.yi-yun.com) for speed control and direction control of the drive unit. In one embodiment, first user input 714 and second user input 716 are combined into a single user input device, such as a direction and throttle lever. Moving the lever in a first direction from a middle position causes drive wheel 720 to rotate in first direction 730 and the offset from the middle position controls the speed of rotation. Similarly, moving the lever in a second, opposite direction from the middle position causes drive wheel 720 to rotate in second direction 734 and the offset from the middle position controls the speed of rotation.

Drive control unit 704 further includes a third user input 710 and a fourth user input 712 which control the actuation of a linear actuator 740 to lengthen and shorten the linear actuator, respectively. In one embodiment, third user input 710 is an input to drive control unit 704 to retract linear actuator 740 to shorten linear actuator 740 and fourth user input 712 is an input to drive control unit 704 to lengthen linear actuator 740. As explained herein, the shortening and lengthening of actuator 740 raises and lower, respectively, drive wheel 720. An exemplary linear actuator is Model No. LA23 available from Linak U.S. Inc. located at 2200 Stanley Gault Parkway in Louisville Ky. 40223. Exemplary user inputs include buttons, switches, levers, touch screen, joysticks, and other devices capable of receiving an operator input. In one embodiment, third user input 710 and fourth user input 712 are combined into a single user input device, such as a lever. Moving the lever in a first direction lengthens the actuator 740 while moving the lever in a second, opposite direction shortens the actuator 740.

Referring to FIG. 37, drive unit 702 is supported by second base 156 of bed 100. In particular, drive unit 702 is supported by a cross frame member 744 which spans between caster wheel receivers 742. Caster wheel receivers 742 receive a stem of respective caster wheels 104. A drive system frame 748 is supported by frame member 744. As shown in FIG. 37, drive system frame 748 includes a swing arm 750 which as explained herein is rotatably mounted to frame member 744 and is coupled to motorized differential transaxle 722.

Drive system frame 748 includes a pair of spaced apart mounting frame members 752 which are coupled to frame member 744 and extend downward from frame member 744. Each one of mounting frame members 752 includes an opening 754. Openings 754 are aligned and receive a mounting rod 756. Mounting rod 756 is further received within an opening 758 in swing arm 750. Swing arm 750 pivots about mounting rod 756 in direction 760 and direction 762 to raise and lower drive wheel 720. Mounting rod 756 is held in place with clip pins 766.

Figure 38:
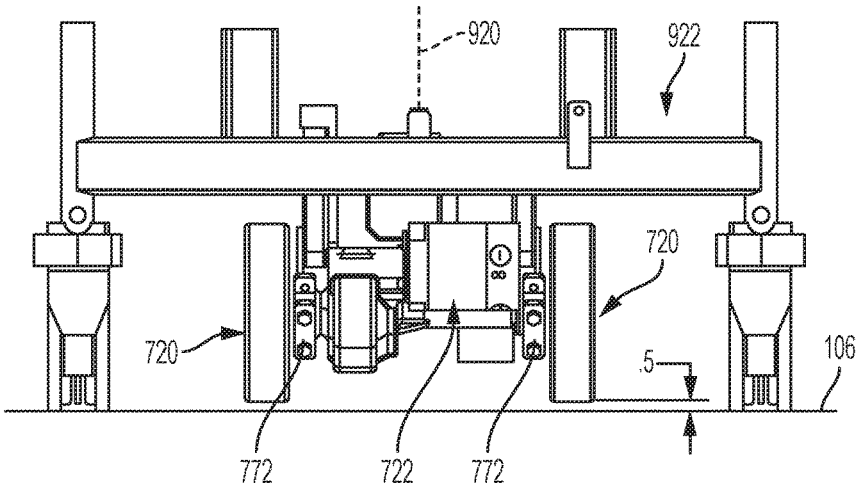
FIG. 38 illustrates an end view of the exemplary drive system of FIG. 37 in a raised configuration.

Motorized differential transaxle 722 is secured to swing arm 750 by sandwiching a portion 768 of motorized differential transaxle 722 between a mounting face 770 of swing arm 750 and a retaining plate 772. Retaining plate 772 is secured to mounting face 770 of swing arm 750 with retainers 774. One of the drive wheels 720 is removed in FIG. 37 to illustrate one instance of the coupling of motorized differential transaxle 722 to swing arm 750. As illustrated in FIG. 38, a respective drive wheel 720 is provided on each side of motorized differential transaxle 722 and motorized differential transaxle 722 is coupled to swing arm 750 on each side of motorized differential transaxle 722.

Swing arm 750 includes a lever arm 780 extending upward from swing arm 750. Lever arm 780 includes a retaining member 782 which receives a first end 785 of a compression spring 784. A second end 787 of compression spring 784 is received in a retaining member 786 of frame member 788. In the illustrated embodiment, retaining member 782 and retaining member 786 are cup features which receive compression spring 784. Frame member 788 is coupled to frame member 744.

Compression spring 784 biases swing arm 750 and hence drive wheel 720 in direction 762. Compression spring 784 further acts as a suspension which allows drive wheel 720 to move upward in direction 132 by the rotation of swing arm 750 in direction 760. This allows bed 100 to accommodate uneven spots in floor 106 while maintaining drive wheel 720 in contact with floor 106.

Linear actuator 740 includes a top end 790 and a bottom end 796. The bottom end 796 includes a screw mechanism which allows a length of linear actuator 740 to be shortened or lengthened. Linear actuator 740 is coupled at its top end 790 to frame member 744 through mounting member 792. Linear actuator 740 is held onto mounting member 792 with a retaining clip 794. Linear actuator 740 engages swing arm 750 at the bottom end 796 of linear actuator 740. Bottom end 796 supports an engagement member 798, illustratively a pin and retaining clips. Engagement member 798 is received in elongated slots 928 in arms 924 of swing arm 750. In the illustrated embodiment, elongated slots 928 have an open end 930.

Figure 39:
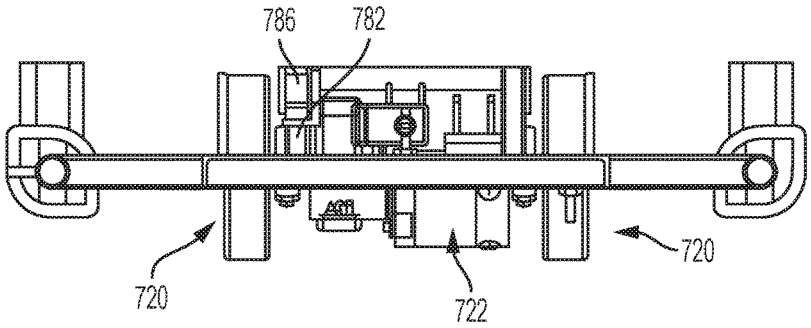
FIG. 39 illustrates a top view of the exemplary drive system of FIG. 37 in the raised configuration.
Figure 40:
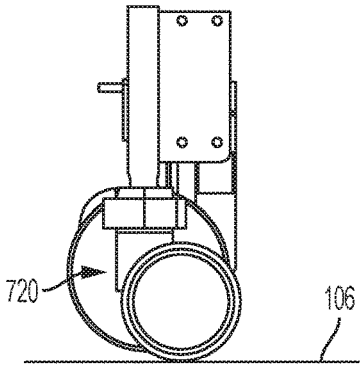
FIG. 40 illustrates a side view of the exemplary drive system of FIG. 37 in the raised configuration.

During a normal operation of bed 100, drive wheels 720 are raised relative to floor 106. In one example, drive wheels 720 are held by linear actuator 740 about 0.5 inches above floor 106. This permits bed 100 to be manually rolled about over floor 106. This arrangement is illustrated in FIGS. 38-40. In this configuration, compression spring 784 is compressed between retaining member 782 and retaining member 786. To place drive wheels 720 in this configuration, an operator actuates third user input 710 which is an input to drive control unit 704 to retract linear actuator 740 to shorten linear actuator 740. In one embodiment, linear actuator 740 is fully retracted when third user input 710 is actuated.

To engage drive wheels 720 with floor 106, an operator actuates fourth user input 712 which is an input to drive control unit 704 to lengthen linear actuator 740. In one embodiment, linear actuator 740 is fully extended when fourth user input 712 is actuated. As linear actuator 740 is lengthened, swing arm 750 is rotated in direction 762 due to the weight of motorized differential transaxle 722 and the partial decompression of compression spring 784. Elongated slots 928 permit linear actuator 740 to be fully extended regardless of when drive wheels 720 contact floor 106.

Figure 45:
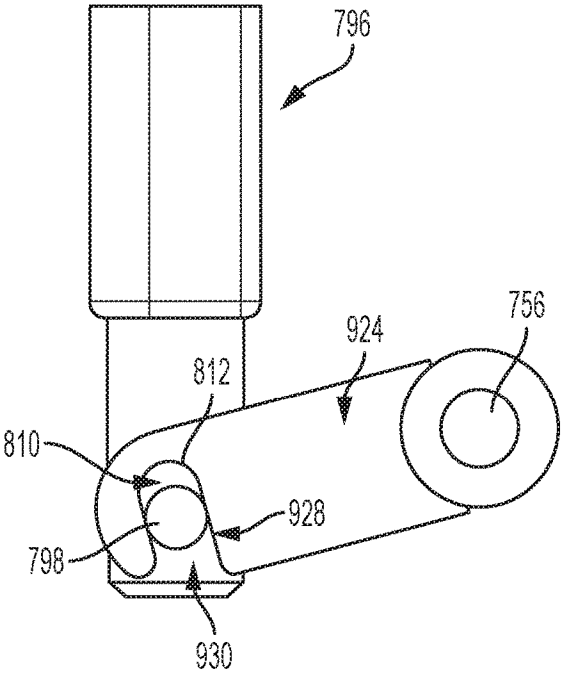
FIGS. 44 and 45 illustrate the rotation of a swing arm due to a bump on the floor.
Figure 44:
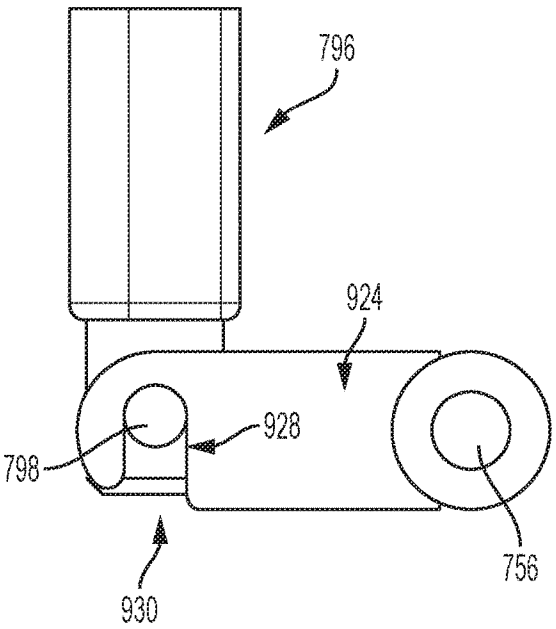

The elongated slots 928 permit movement between arm 924 and bottom end 796 of linear actuator 740. This configuration allows swing arm 750 to move upward in direction 132 due to a rotation of swing arm 750 in direction 760 without changing a length of linear actuator 740. As illustrated in FIGS. 44 and 45, if swing arm 750 is rotated in direction 760 due to a bump on floor 106, a gap 810 is provided between an end 812 of elongated slot 928 and engagement member 798. As such, elongated slots 928 act as a "slip joint" to protect linear actuator 740 from damage by back pressure from uneven floors, bumps, etc.

Figure 41:
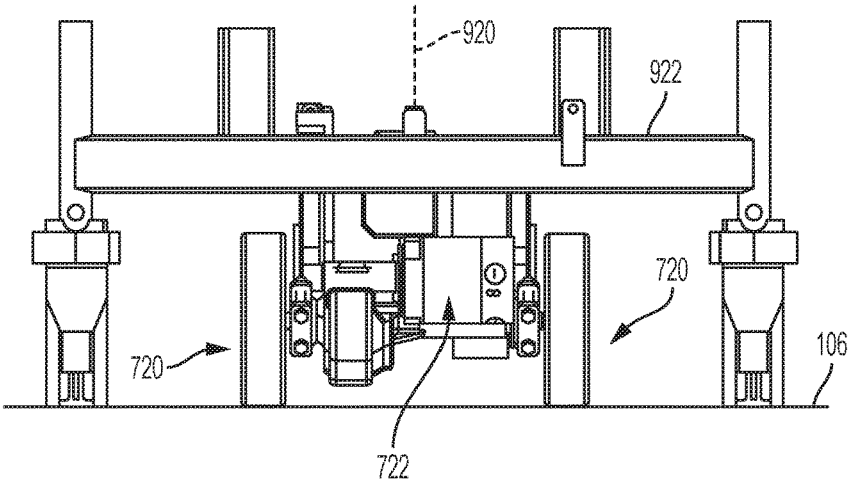
FIG. 41 illustrates an end view of the exemplary drive system of FIG. 37 in a lowered configuration.
Figure 42:
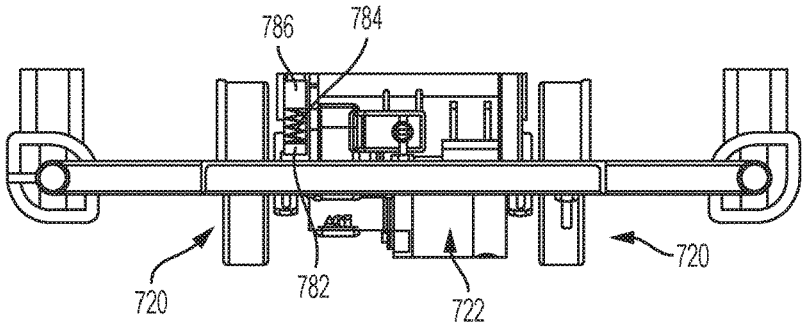
FIG. 42 illustrates a top view of the exemplary drive system of FIG. 37 in the lowered configuration.
Figure 43:
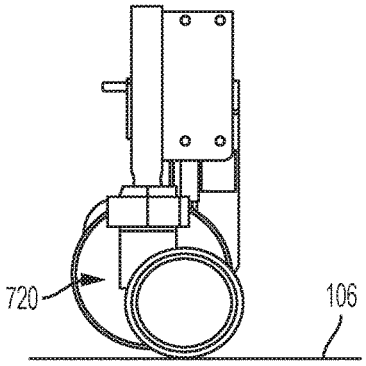
FIG. 43 illustrates a side view of the exemplary drive system of FIG. 37 in the lowered configuration.

Elongated slots 928 further permit linear actuator 740 to maintain a consistent orientation relative to a top surface 922 of frame member 744. As shown in FIGS. 37, 38, and 41, linear actuator 740 lengthens and shortens along an axis 920. Axis 920, in the illustrated embodiment, is perpendicular to top surface 922 of frame member 744 when linear actuator 740 is retracted (see FIG. 38) and lengthened (see FIG. 41).

In one embodiment, when drive wheels 720 engage floor 106, the operator also places the wheels 104 adjacent to drive wheel 720 in a steer mode with the wheels 104 in line with drive wheels 720 (see FIG. 38) while the wheels 104 at the opposite end of bed 100 are permitted to freely rotate or swivel. Since motorized differential transaxle 722 is a differential transaxle, it is possible to have a left side drive wheel 720 to rotate in one of direction 760 and direction 762 and the right side drive wheel 720 to rotate in the other of direction 760 and direction 762. This arrangement aids an operator in turning bed 100 to the left or the right. In one embodiment, drive control unit 704 includes an additional user input 718 which instructs motorized differential transaxle 722 to rotate the two drive wheel 720 in opposite directions to cause bed 100 to turn to the left or the right. Exemplary user inputs include buttons, switches, levers, touch screen, joysticks, and other devices capable of receiving an operator input.

While this disclosure includes particular examples, it is to be understood that the disclosure is not so limited. Numerous modifications, changes, variations, substitutions, and equivalents will occur to those skilled in the art without departing from the spirit and scope of the present disclosure upon a study of the drawings, the specification, and the following claims.

The invention claimed is:

1. A bed adapted to be supported on a floor, comprising:

a plurality of wheels;

a headboard and a footboard, the footboard spaced apart from the headboard, the headboard and the footboard supported by the plurality of wheels;

a support deck supported by the plurality of wheels, the support deck including a head end positioned proximate the headboard and a foot end positioned proximate the footboard, and at least one support surface extending between the head end of the support deck and the foot end of the support deck;

a first lift system supported by the plurality of wheels, the first lift system operatively coupled to the support deck to raise and lower the support deck relative to the plurality of wheels while the plurality of wheels remain stationary; and a second lift system supported by the plurality of wheels, the second lift system operatively coupled to the support deck to raise and lower the support deck relative to the plurality of wheels while the plurality of wheels remain stationary, the second lift system including a lower frame, an upper frame, and a lifting assembly coupled to the lower frame and the upper frame, the second lift system being moveable from an unexpanded configuration wherein the lower frame and the upper frame are separated by a first separation to a first expanded configuration wherein the lower frame and the upper frame are separated by a second separation due to a downward movement of the lower frame relative to the plurality of wheels and a second expanded configuration due to an upward movement of the upper frame relative to the plurality of wheels.

2. The bed of claim 1, wherein the first lift system is operatively coupled to the second lift system to raise and lower the second lift system relative to the plurality of wheels while the plurality of wheels remain stationary.

3. The bed of claim 1, wherein the first lift system is further configured to raise and lower at least one of the head end of the support deck and the foot end of the support deck independent of the other of the head end of the support deck and the foot end of the support deck and the second lift system is further configured to raise and lower at least one of the head end of the support deck and the foot end of the support deck independent of the other of the head end of the support deck and the foot end of the support deck.

4. The bed of claim 1, wherein the first lift system does not alter a position of the support deck relative to the second lift system as the first lift system raises or lowers the second lift system relative to the plurality of wheels.

5. The bed of claim 1, wherein the plurality of wheels define a horizontally extending envelope and wherein when viewed from a top view, both of the first lift system and the second lift system are positioned within the horizontally extending envelope defined by the plurality of wheels.

6. The bed of claim 1, wherein the second lift system is configured to raise and lower the support deck independently of the first lift system.

7. The bed of claim 1, wherein the second lift system is supported by the first lift system through a plurality of load cells.

8. The bed of claim 7, wherein the upper frame of the second lift system is supported by the lower frame of the second lift system and the lower frame of the second lift system is moveably coupled to the plurality of load cells through a plurality of elongated members.

9. The bed of claim 7, wherein the plurality of loads cells supports the second lift system through the upper frame of the second lift system when the second lift system is in the unexpanded configuration and the first expanded configuration and wherein the plurality of load cells supports the second lift system through the lower frame of the second lift system when the second lift system is in the second expanded configuration.

* * * * *